US010881892B2

(12) United States Patent
McCall

(10) Patent No.: US 10,881,892 B2
(45) Date of Patent: Jan. 5, 2021

(54) WORKOUT APPARATUS

(71) Applicant: Shannon McCall, Lacey Springs, AL (US)

(72) Inventor: Shannon McCall, Lacey Springs, AL (US)

( * ) Notice: Subject to any disclaimer, the term of this patent is extended or adjusted under 35 U.S.C. 154(b) by 0 days.

(21) Appl. No.: 16/092,811

(22) PCT Filed: Jun. 10, 2017

(86) PCT No.: PCT/IB2017/053443

§ 371 (c)(1),
(2) Date: Oct. 11, 2018

(87) PCT Pub. No.: WO2017/179031

PCT Pub. Date: Oct. 19, 2017

(65) Prior Publication Data

US 2019/0134451 A1 May 9, 2019

Related U.S. Application Data

(60) Provisional application No. 62/320,647, filed on Apr. 11, 2016.

(51) Int. Cl.
*A63B 21/06* (2006.01)
*A63B 21/00* (2006.01)
(Continued)

(52) U.S. Cl.
CPC ..... *A63B 21/0615* (2013.01); *A63B 21/0083* (2013.01); *A63B 21/015* (2013.01);
(Continued)

(58) Field of Classification Search
CPC ..... A63B 21/0615; A63B 71/0054; A63B 21/0083; A63B 21/151; A63B 21/015;
(Continued)

(56) References Cited

U.S. PATENT DOCUMENTS 285,934 A * 10/1883 Smith et al. ..... D06F 7/04 68/142
402,454 A * 4/1889 Horton ..... B63B 13/02 114/198

(Continued)

FOREIGN PATENT DOCUMENTS

EP 0402454 * 12/1989
EP 0402454 B1 2/1995

(Continued)

OTHER PUBLICATIONS

PCT/1132017/053443 International Search Report and Written Opinion, dated Sep. 19, 2017, 10 pages.

(Continued)

*Primary Examiner* — Garrett K Atkinson
(74) *Attorney, Agent, or Firm* — Waller Lansden Dortch & Davis, LLP; Blake M. Bernard

(57) ABSTRACT

A workout apparatus 10 includes base 12. A lifting arm 14 is pivotally connected to base 12 and movable on base 12 between a raised position and a lowered position, the lifting arm 14 including a first end 14*a* pivotally connected to base 12 and a second end 14*b* opposite the first end, the second end 14*b* including a gripping end piece 16. At least one weight post 32 extends outward from lifting arm 14 at a location between first end 14*a* and second end 14*b* of lifting arm 14. A braking system 18 is mounted to base 12 and coupled to lifting arm 14. Braking system 18 allows lifting arm 14 to move toward the raised position freely. Braking system 18 is engaged as lifting arm 14 moves towards the lowered position to lower lifting arm 14 toward the lowered position at a controlled rate of speed.

14 Claims, 19 Drawing Sheets

(51) Int. Cl.

| | |
|---|---|
| ***A63B 21/22*** | (2006.01) |
| ***A63B 23/04*** | (2006.01) |
| ***A63B 23/12*** | (2006.01) |
| ***A63B 21/015*** | (2006.01) |
| ***A63B 71/00*** | (2006.01) |
| ***A63B 21/008*** | (2006.01) |
| ***A63B 71/02*** | (2006.01) |

(52) U.S. Cl.
CPC ..... *A63B 21/151* (2013.01); *A63B 21/157* (2013.01); *A63B 21/225* (2013.01); *A63B 21/4035* (2015.10); *A63B 23/0405* (2013.01); *A63B 23/1209* (2013.01); *A63B 71/0054* (2013.01); *A63B 21/00069* (2013.01); *A63B 21/158* (2013.01); *A63B 23/047* (2013.01); *A63B 2071/0072* (2013.01); *A63B 2071/024* (2013.01)

(58) Field of Classification Search
CPC ..... A63B 21/4035; A63B 23/1209; A63B 23/0405; A63B 21/225; A63B 21/157; A63B 21/00069; A63B 23/047; A63B 21/158; A63B 2071/024; A63B 2071/0072
See application file for complete search history.

(56) References Cited

U.S. PATENT DOCUMENTS 3,256,015 A * 6/1966 Perrin ..... A63B 21/04 482/129
3,751,031 A * 8/1973 Yamauchi ..... A63B 21/065 482/105
3,953,024 A * 4/1976 Brubacher ..... B63B 35/73 472/127
3,972,238 A * 8/1976 Thatcher ..... A61B 5/224 482/128
4,618,142 A * 10/1986 Joseph, Jr. ..... A63B 5/20 482/106
4,854,578 A * 8/1989 Fulks ..... A63B 21/00072 482/100
5,417,635 A * 5/1995 Sell ..... A63B 21/0605 482/105
5,531,657 A * 7/1996 Macedo ..... A63B 21/0084 482/106
5,653,665 A * 8/1997 Neeley ..... A63B 21/0552 482/106
5,788,612 A * 8/1998 Rennick ..... A63B 69/208 482/83
6,612,971 B1 * 9/2003 Morris ..... A63B 23/047 473/441
D505,459 S * 5/2005 Lagattuta ..... D21/680
6,942,585 B1 * 9/2005 Krause ..... A63B 69/002 473/445
7,322,905 B2 * 1/2008 Morris ..... A63B 23/047 482/118
D579,990 S * 11/2008 Dalcourt ..... D21/662
7,806,813 B2 * 10/2010 Campitelli ..... A63B 21/00072 482/137
8,109,863 B2 * 2/2012 Gilberti ..... A63B 21/0603 473/438
8,231,511 B2 * 7/2012 Dalcourt ..... A63B 21/0607 482/106
8,360,938 B2 * 1/2013 Gilman ..... A63B 21/0615 482/51
8,622,878 B2 * 1/2014 Abelbeck ..... A63B 21/0724 482/93
8,651,972 B2 * 2/2014 Hoeschler ..... A63B 22/16 446/153
9,144,704 B1 * 9/2015 Abelbeck ..... A63B 21/08
9,717,941 B2 * 8/2017 Gagnon ..... A63B 21/4047
10,022,580 B2 * 7/2018 Tyree ..... A63B 21/0616
D831,760 S * 10/2018 Safranka ..... D21/686
2003/0224914 A1 * 12/2003 De Montesquieux ..... A63B 21/0552 482/148
2004/0002408 A1 * 1/2004 Rigas ..... A63B 5/20 482/82
2006/0040800 A1 * 2/2006 Slyter ..... A63B 21/00181 482/94
2006/0116256 A1 * 6/2006 Carney ..... A63B 21/0724 482/106
2006/0264300 A1 * 11/2006 Chen ..... A63B 21/072 482/14
2007/0155596 A1 * 7/2007 Rogers ..... A63B 21/0615 482/97
2007/0249472 A1 * 10/2007 Frei ..... A45B 1/02 482/66
2007/0287609 A1 * 12/2007 McBride ..... A63B 21/065 482/105
2009/0312160 A1 * 12/2009 Higgins ..... A63B 23/025 482/94
2010/0285934 A1 * 11/2010 Abelbeck ..... A63B 21/00072 482/97
2012/0149535 A1 * 6/2012 Abelbeck ..... A63B 21/0724 482/93
2013/0095984 A1 * 4/2013 Agate ..... A63B 21/0618 482/106
2013/0130814 A1 * 5/2013 Hoeschler ..... A63B 22/16 472/127
2014/0145407 A1 * 5/2014 Chen ..... B62B 1/22 280/47.12
2015/0126344 A1 * 5/2015 Wehrell ..... A63B 23/047 482/128
2015/0165258 A1 * 6/2015 Januszek ..... A63B 21/072 482/93
2016/0361584 A1 * 12/2016 Towley ..... A63B 21/0618
2016/0361585 A1 * 12/2016 Gagnon ..... A63B 21/4035
2017/0014668 A1 * 1/2017 Haddad ..... A63B 21/4035
2017/0266486 A1 * 9/2017 Anderson ..... A63B 21/4049
2017/0296858 A1 * 10/2017 Towley ..... A63B 23/047
2018/0015318 A1 * 1/2018 Nelson ..... A63B 23/12

FOREIGN PATENT DOCUMENTS

JP 2003-508136 A 3/2003
JP 3648754 B2 5/2005
JP 2011/139779 * 7/2011
JP 2011-139779 A 7/2011
WO PCT/IB201/053443 * 6/2017

OTHER PUBLICATIONS

JP 2003-508136 (Prospot, Inc.) Mar. 4, 2003, Patent Abstract, 2 pages.

* cited by examiner

WORKOUT APPARATUS

TECHNICAL FIELD

The present disclosure relates generally to exercise equipment.

BACKGROUND ART

The present disclosure relates generally to exercise equipment.

More particularly, the present disclosure relates to an apparatus that allows one to simulate a tire flipping workout motion.

Tire flipping workouts are known in the art. As the name suggests, tire flipping workouts (also referred to as tire tipping workouts) involve raising a tire or other large object laying on the ground from a horizontal to a vertical position and then pushing the tire over so that it falls back down to a horizontal position again such that the tire or object is flipped end over end continuously. Current tire flipping type workouts, however, have a number of disadvantages.

First, tire flipping exercises or other exercises where objects are flipped over continuously require a lot of space because the tire moves forward each time it is flipped over. Second, you can only adjust the weight being lifted by using different sized tires or objects (typically ranging from 200 lbs. to 1000 lbs.) so you need multiple tires in order to workout using different weights. There are also safety issues associated with current tire flipping type exercises because the tire or object being flipped can roll in unexpected directions when it is flipped over and can injure or cause damage to nearby people or structures. In addition, tires can fall back on users when users try to lift tires that are too heavy, or if a user slips and falls during a lift.

What are needed then are improvements to tire flipping exercise equipment.

DISCLOSURE OF THE INVENTION

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the present invention relates to a workout apparatus, including a base. A lifting arm is pivotally connected to the base and movable on the base between a raised position and a lowered position, the lifting arm including a first end pivotally connected to the base and a second end opposite the first end, the second end including a gripping end piece. In some embodiments, the gripping end piece can be tire-shaped. At least one weight post extends outward from the lifting arm at a location between the first end and the second end of the lifting arm. A braking system is mounted to the base and coupled to the lifting arm. The braking system allows the lifting arm to move toward the raised position freely. However, the braking system is engaged as the lifting arm moves towards the lowered position to lower the lifting arm toward the lowered position at a controlled rate of speed. The apparatus can use common disk type or Olympic type weights for weight resistance, which can be received on the weight posts.

During the lifting exercise, the gripping end piece is pushed or tipped upward to a raised and generally vertical position and then is released and allowed to fall back down to a lowered or generally horizontal position. In various embodiments, the braking system can include a brake drum or flywheel, friction belts, brake pads, a fan type brake drum or flywheel, a water/hydro type viscous torque converter type wheel clutch, air/hydraulic/gas cylinders, or any combination thereof. The braking system can help slow the descent of the lifting arm as it moves to the lowered position in order to help prevent free falling of the lifting arm and the weights thereon once the lifting or tipping motion is complete, or when a user has to bail out or give up on a lift. This braking system allows the lifting arm to gradually descend to the lowered position which can help reduce injury to the user and observers or objects nearby. Once the lifting arm returns to the lowered position the lifting motion can be repeated.

The workout apparatus of the present disclosure provides benefits over conventional tire flipping workouts, or other workouts where objects are flipped over continuously in an end to end fashion. The apparatus is generally stationary, and thus can require less space than traditional tire flipping type workouts. Additionally, unlike a free weight tire, the motion of the lift is controlled by the apparatus, such that the gripping end piece can be prevented from rolling in an unintended direction, meaning to the left or right, or in some cases of an uneven lift, pivoting or yawing thus making the situation even more hazardous to a user and other observers or obstacles nearby. Such a controlled motion can also help to encourage proper lifting technique by a user. Additionally, if the weight is too great for a user, the designed braking system can help control the rate of descent of the lifting arm to allow the user to clear the area; however, the braking system is designed to add little to no resistance to the lifting arm during the lifting motion. The apparatus can also be used indoors year round, while conventional tire flipping type workouts are performed outside, which can be affected by weather conditions. Furthermore, additional weight can simply be added to the weight posts of the apparatus without the need to have tires or objects of varying size and weight. Because of the beneficial safety features incorporated into the apparatus of the present disclosure, novice or weaker individuals interested in tire flipping type exercises can be encouraged to attempt the exercises, as the apparatus uses common plate type weights which makes the resistance levels easily adjustable to their strength or fitness level and the apparatus can reduce the risk of injury and discomfort associated with an imbalanced load due to an improper lift.

Numerous other objects, advantages and features of the present disclosure will be readily apparent to those of skill in the art upon a review of the following drawings and description of a preferred embodiment.

BEST MODE FOR CARRYING OUT THE INVENTION

Figure 1:
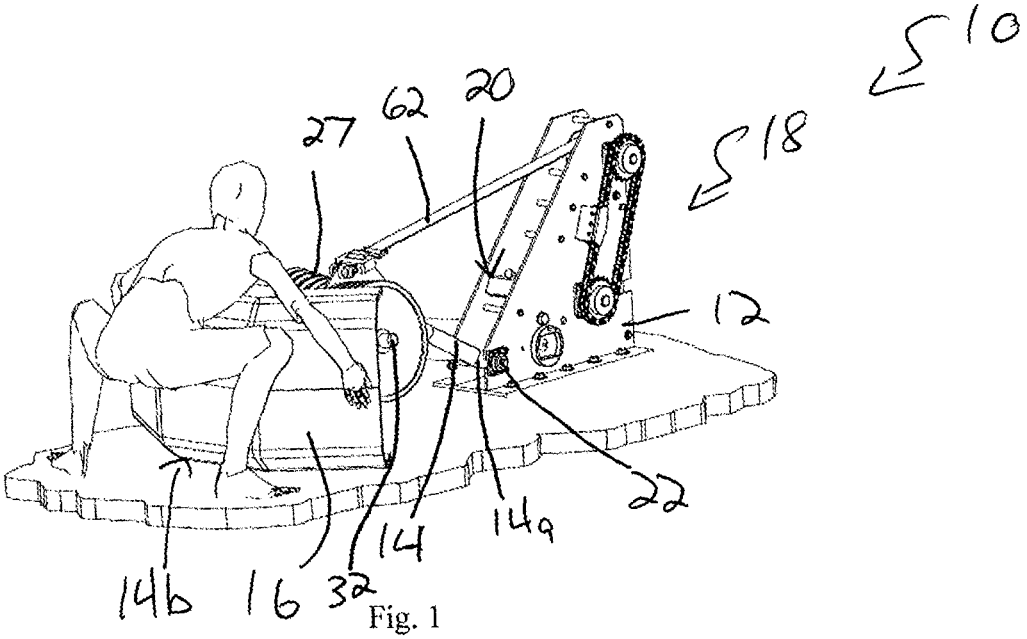
FIG. 1 is a front perspective view showing one embodiment of a workout apparatus of the present disclosure in a starting position.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

In various embodiments as described in more detail below, the apparatus may include a tire like front end attached to a lifting arm capable of receiving common disk type or Olympic type weights. In other embodiments, the front end of the apparatus which is gripped or lifted by a user can include a variety of suitable shapes and in some embodiments the gripped front end can include padding, straps, or other features which can add comfort to the user during a lift. In some embodiments, the lifting arm can be adaptable to receive kettle bell type weights or any other suitable weight or load material for either increasing or decreasing the resistance to lifting the gripped end from a lowered position to a raised position when performing exercises. In some embodiments, this lifting arm may be pivotally connected to a pivot point on a base. The lifting arm can additionally be coupled to a braking system. The braking system in some embodiments can include a friction strap engaging a brake drum or flywheel, one or more brake pads engaging a brake drum or flywheel, a fan type brake drum or flywheel, a water/hydro type viscous torque converter brake system, one or more air/hydraulic/gas cylinder, or any combination thereof. The various types of braking systems serve to slow the descent of the lifting arm and the weights thereon to prevent free falling of the weights once the lifting motion for a tire flipping type exercise is complete, meaning the lifting arm is raised from a lowered position to a raised position, and the lifting arm is subsequently released or moved back toward the lowered position. The braking system allows the lifting arm and the weights thereon to be released and returned to the lowered position at a controlled rate of speed to help reduce injuries or damage associated with a free fall of the lifting arm on the apparatus. Once the lifting arm has returned to the lowered position, the lifting exercise motion can be performed again.

The braking system is designed to reduce any resistance associated with the braking system when the lifting exercise motion is performed and the lifting arm is lifted to a raised position. The braking system is only engaged as the load is returning to the lower position, for instance after completion of a full lifting motion or during a bail out situation when a user gives up on the lift. Additionally, the speed/sensitivity of braking can be adjustable in some embodiments. In some embodiment, steel can be used for the various components of the lifting apparatus, although any materials of suitable strength and durability can be used. In some embodiments, the present invention can have a locking device or system, such as clamps, toggle clamps, screws, cables, hooks, or other combinations or orientations which allow the lifting arm to be locked in the up or down position, thus allowing another level of safety for fold up storage or other uses. The present invention may be manufactured in several colors for added visual safety, or style, during use and for marketing purposes (to heighten appeal).

Figure 2:
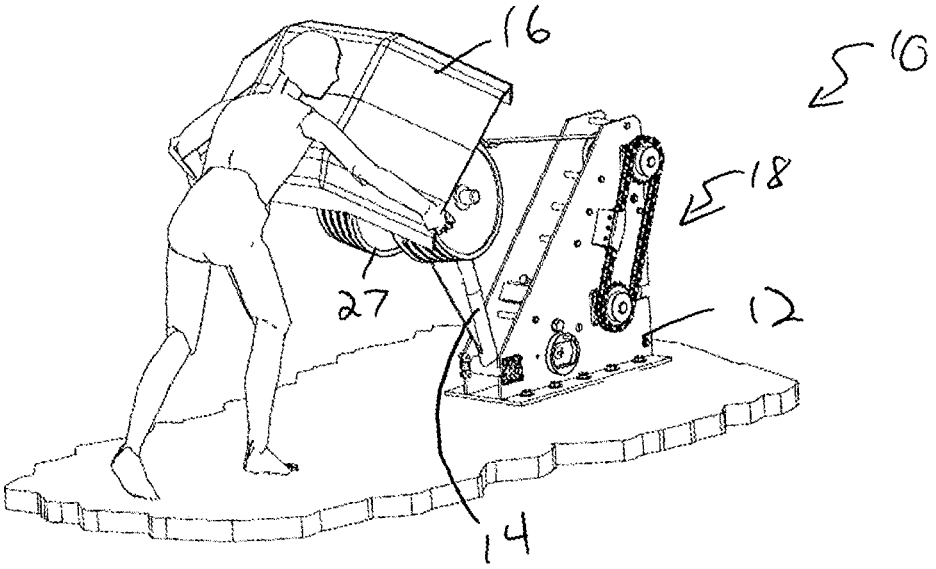
FIG. 2 is a front perspective view showing the apparatus of FIG. 1 in a mid-lift position.
Figure 3:
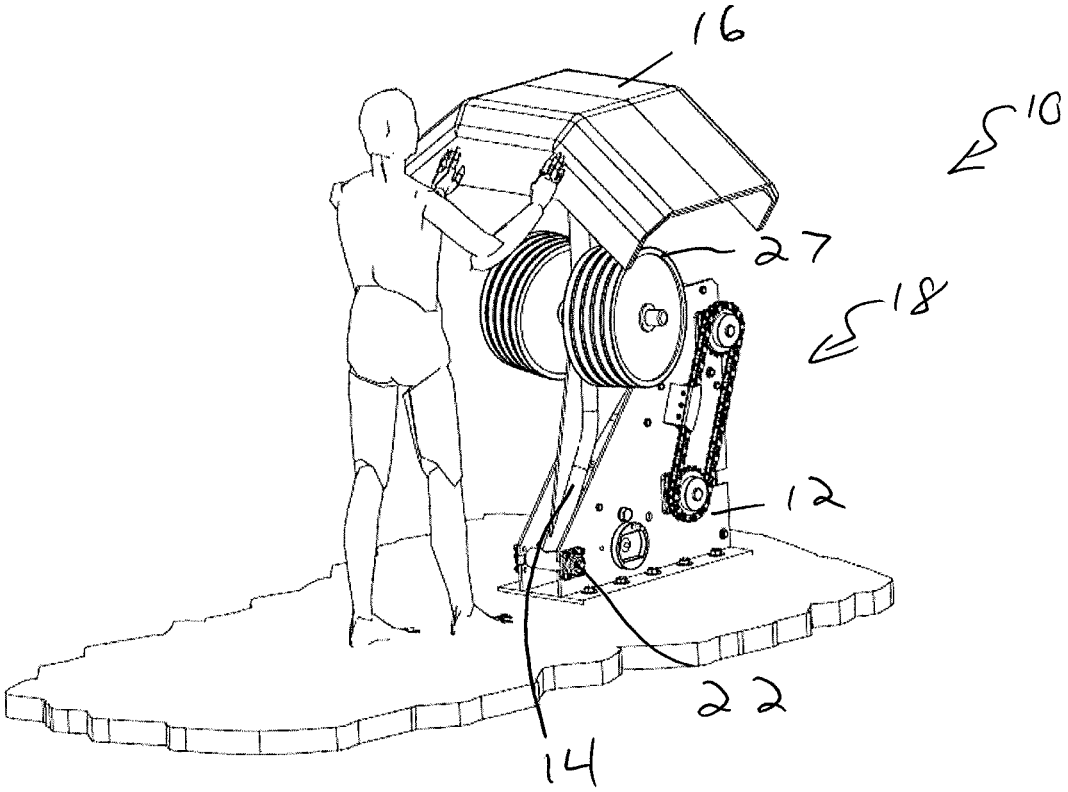
FIG. 3 is a front perspective view showing the apparatus of FIG. 1 in a final position.

Referring now to FIGS. 1-3, one embodiment of the workout apparatus 10 of the present invention may include a base 12 and a lifting arm 14 pivotally connected to the base 12. In some embodiments, the base 12 can be rigidly secured to a floor or other structure within a workout facility to provide structural support during a lifting exercise using the apparatus 10. The lifting arm 14 can be movable on the base 12 between a lowered or starting position, shown in FIG. 1, and a raised or final position, shown in FIG. 3. The lifting arm 14 can include a first end 14*a* pivotally attached to the base 12, and a second end 14*b* opposite the first end 14*a*, the second end 14*b* including a gripping end piece 16. The gripping end piece 16 can be gripped or grasped by a user to lift the lifting arm 14 during a lifting motion of the apparatus 10. In some embodiments, the gripping end piece 16 can be in the shape of a partial tire to simulate the lifting of a real tire. In other embodiments, the gripping end piece 16 can be any suitable shape, including but not limited to square, round, trapezoidal, spherical, hemispherical, etc. In some embodiments, the gripping end piece 16 can include various features such as pads or straps which can help increase the comfort of the user during the lift, and/or to aid the user with the lift.

The lifting arm of the apparatus 10 may initially be placed in a starting or lowered position, shown in FIG. 1, where the gripping end piece 16 rests on a floor. A user can grab the gripping end piece 16 and begin a lift. The user can lift the gripping end piece 16 and the lifting arm to a mid-lift position, shown in FIG. 2, where the gripping end piece 16 has been partially lifted. The user can continue to lift and or push the gripping end piece 16 and the lifting arm 14 to a raised or final position, shown in FIG. 3, where the gripping end piece 16 has been completely lifted.

Figure 4:
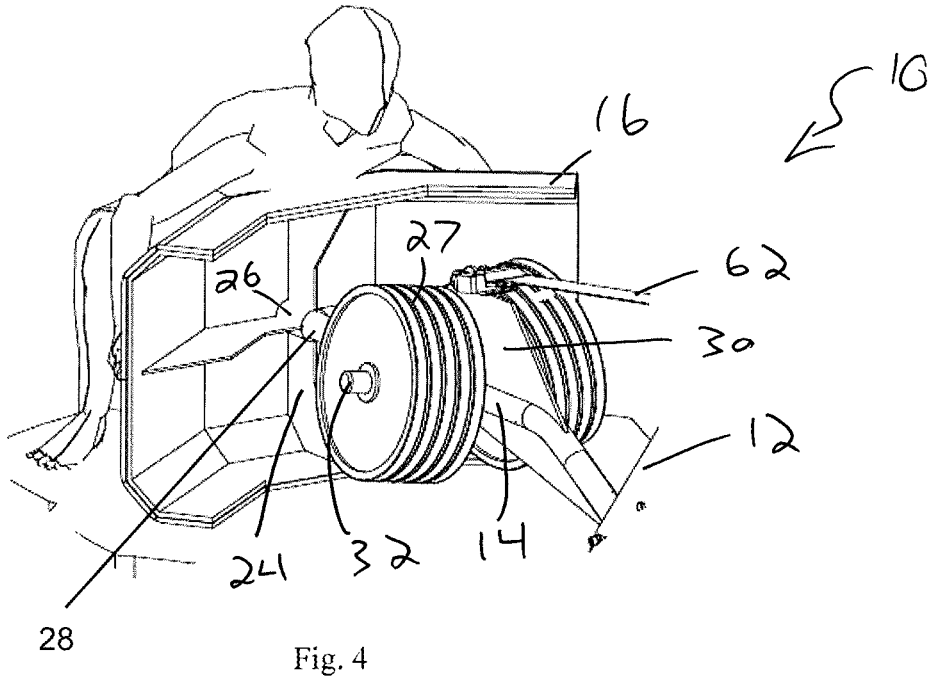
FIG. 4 is a detailed view of a tire-shaped end of a lifting arm of the apparatus of FIG. 1.

As shown in FIG. 4, the gripping end piece 16 may include an inner support frame 24 (which may be star-shaped in some embodiments). The inner support frame 24 may include a circular center portion 26. The lifting arm 14 may include a cylindrical portion 28, a flanged portion 30 extending outward therefrom, and a pair of weight posts 32 extending out from opposite sides of the cylindrical portion 28; and one end of the cylindrical portion 28 may be disposed in or connected to the circular center portion 26. Conventional weights (Olympic or otherwise) 27 may be slid onto or off of the weight posts 32 to increase and decrease the amount of weight lifted by a user.

The apparatus 10 includes a braking system 18 mounted on or within the base 12. The braking system 18 can be configured to allow the lifting arm 14 to freely move from the lowered or starting position to the raised or final position, such that the braking system 18 adds little to no resistance to the lifting arm 14 during the lifting motion. However, upon release of the lifting arm 14, either during a bail out situation or upon completion of a lifting motion, as the lifting arm 14 moves back toward the lowered position, the braking system 18 can be engaged to effectively return the lifting arm 14 and the gripping end piece 16 to the lowered or starting position at a controlled rate of speed.

As shown in FIGS. 1-3 and 9, in some embodiments, as the lifting arm 14 is lifted to the raised position, the lifting arm 14 can abut an angular stop 20 mounted on the base 12. The angular stop 20 can prevent motion of the lifting arm 14 beyond a desired raised position. In some embodiments, when the lifting arm 14 is in the raised position, a center of gravity of the lifting arm 14, the gripping end piece 16, and the weights 27 positioned thereon may be located at position past a pivot point 22 for the lifting arm 14 toward the base 12 or the raised position such that the weight of the lifting arm 14, the gripping end piece 16, and the weights 27 biases the lifting arm 14 toward the raised position. The apparatus 10 may stay in this position until a user pushes the lifting arm 14 back toward the starting position. However, in such an embodiment, the center of gravity of the lifting arm 14, the gripping end piece 16 and the weights 27 can be positioned just passed the "tipping point" over the pivot point 22, such that minimal force is required by the user to force the lifting arm 14 to cross the tipping point such that the lifting arm 14 is biased towards and returns to the lowered position. As the lifting arm 14 returns to the lowered position, the braking system 18 engages and slowly lowers the lifting arm 14 back to the floor at a controlled rate of speed.

Figure 5:
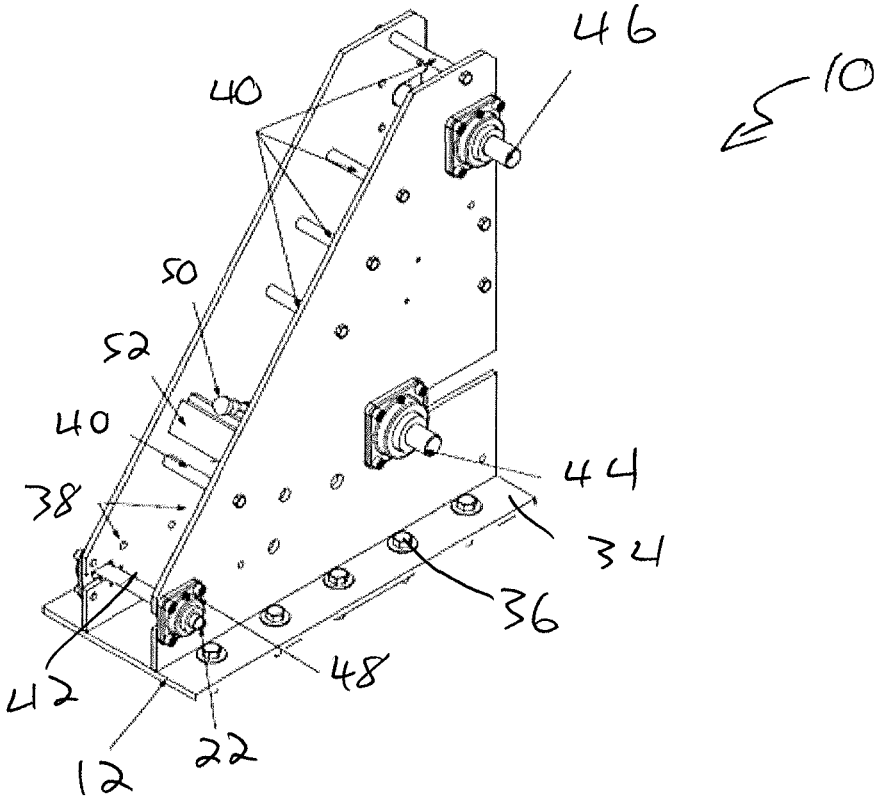
FIGS. 5-6 are detailed perspective views showing a base of the apparatus of FIG. 1.
Figure 6:
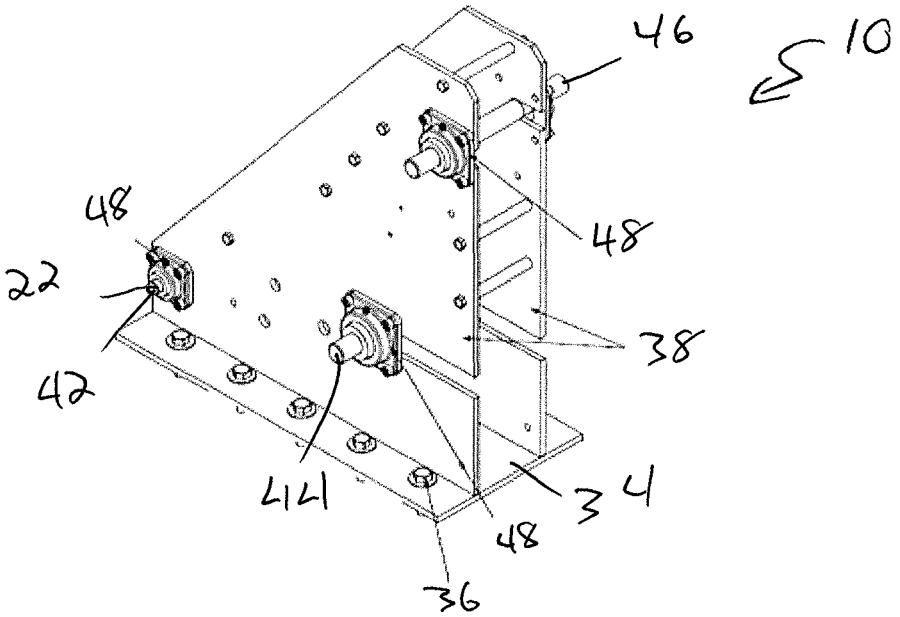
Figure 7:
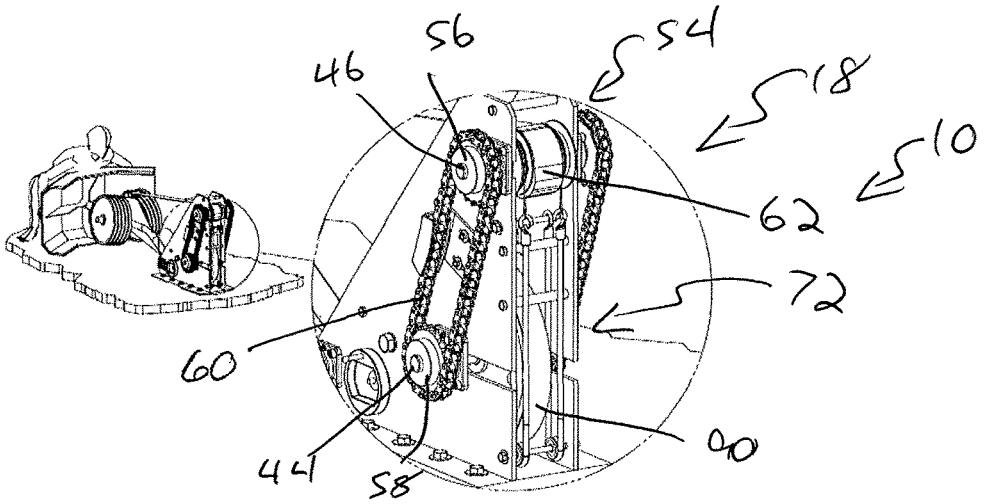
FIGS. 7-8 are detailed perspective views of a braking system of the apparatus of FIG. 1 when the lifting arm is in lowered and raised positions respectively.
Figure 8:
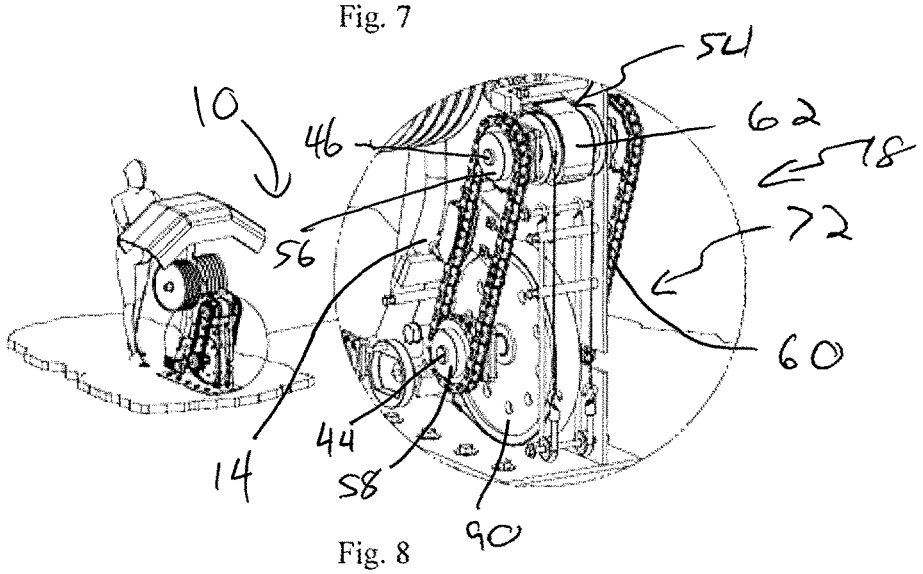
Figure 9:
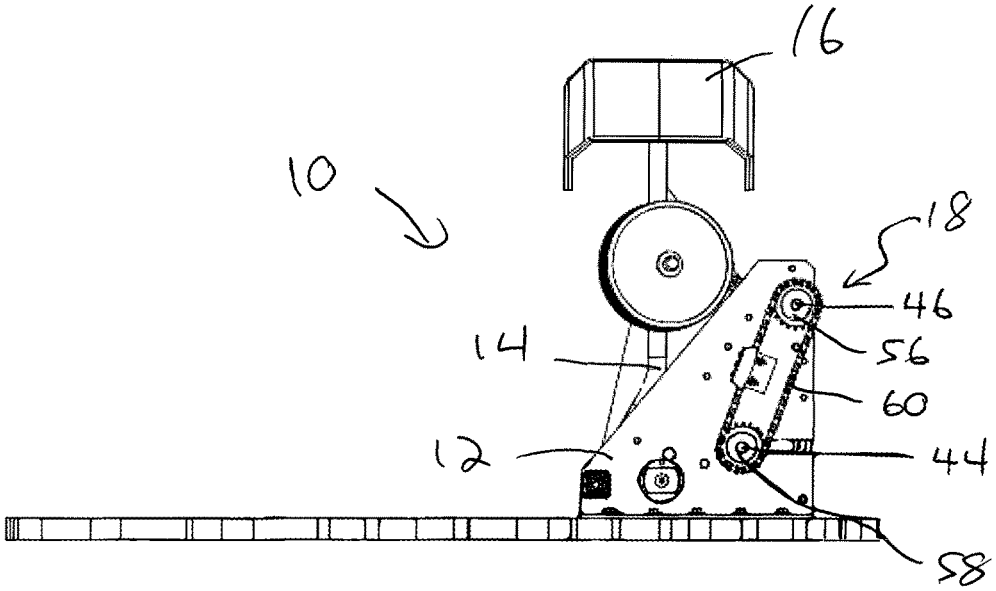
FIGS. 9-11 are side views showing the lifting arm of the apparatus of FIG. 1 being lowered from a raised position to a mid-lift position to a starting position.
Figure 10:
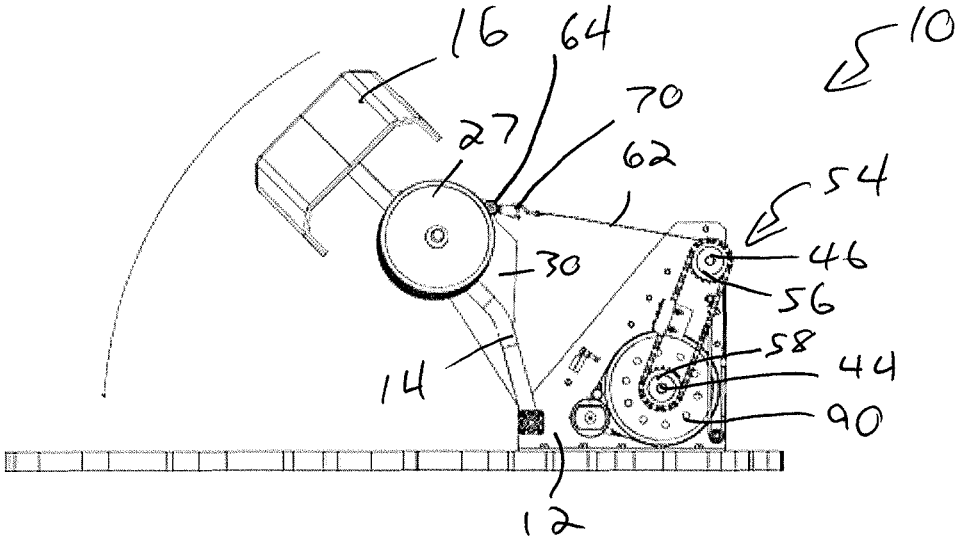
Figure 11:
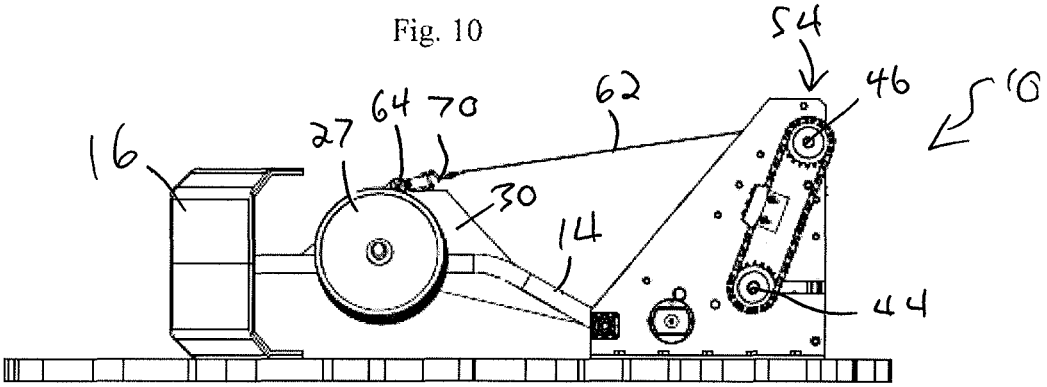
Figure 12:
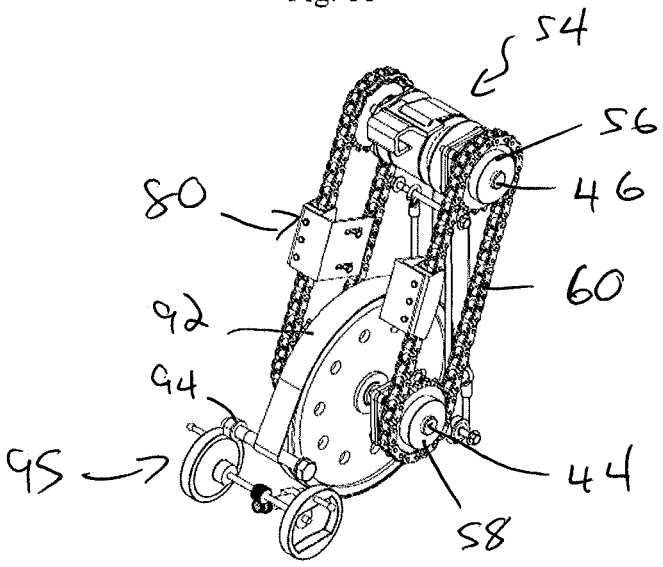
FIGS. 12-13 are perspective views showing an enlarged view of the braking system of the apparatus of FIG. 1.
Figure 13:
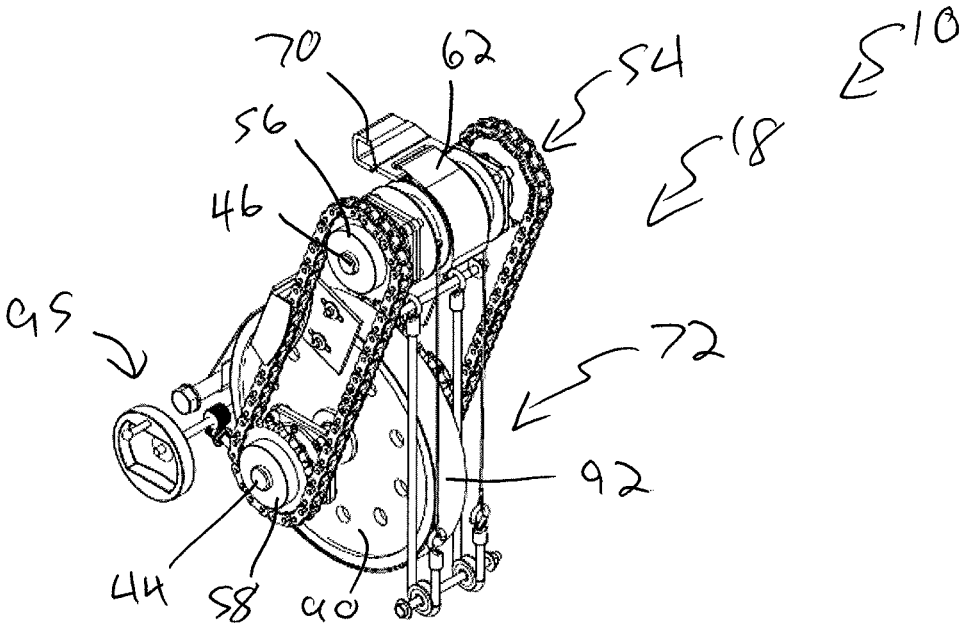
Figure 14:
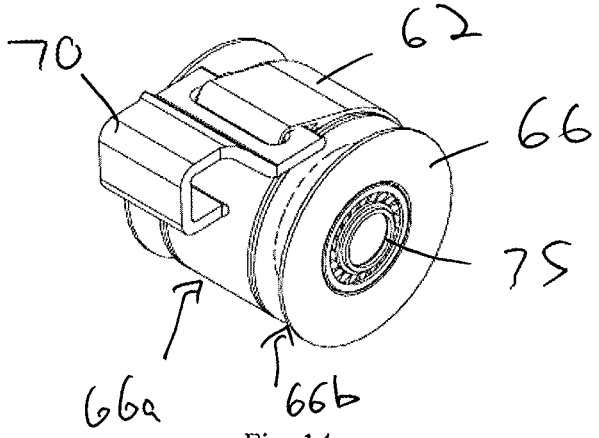
FIG. 14 is a perspective view showing an embodiment of a clutch assembly and tension strap of the apparatus of FIG. 1.
Figure 15:
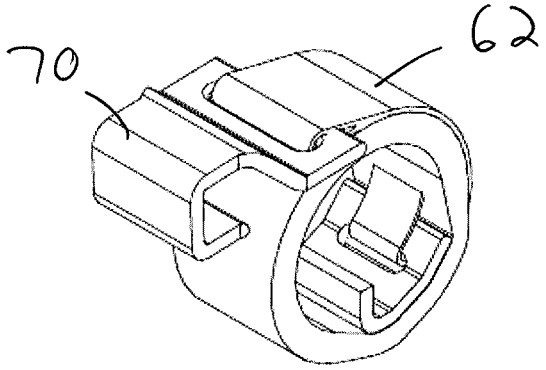
FIG. 15 is a detailed perspective view of the tension strap of FIG. 14.
Figure 16:
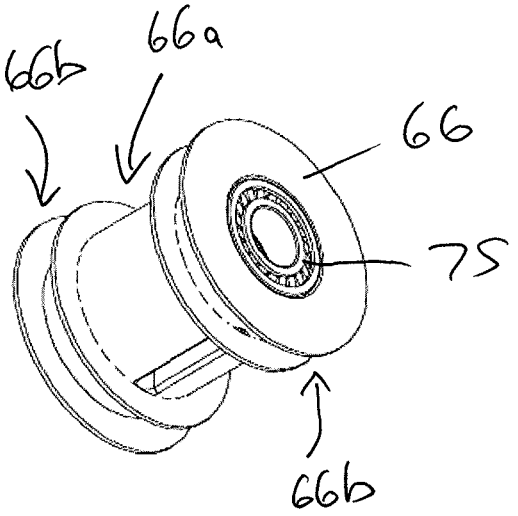
FIG. 16 is a detailed perspective view of the clutch assembly FIG. 14 including a one way bearing.
Figure 17:
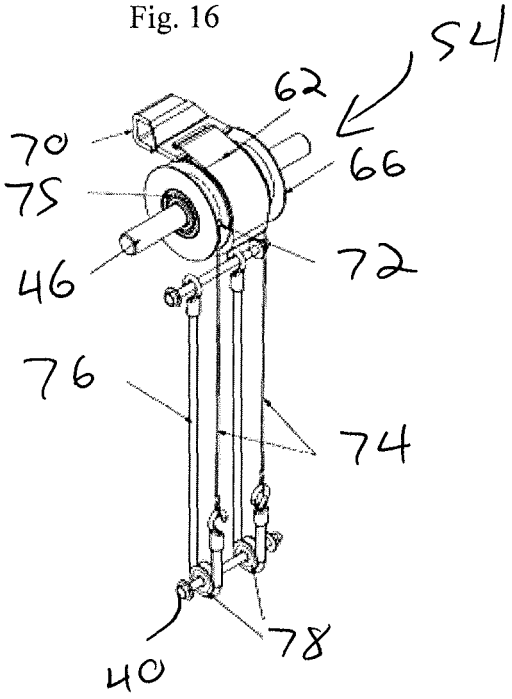
FIGS. 17-19 are perspective views showing an embodiment of a biasing member of the braking system of FIG. 1 as a cable/bungee cord assembly.
Figure 18:
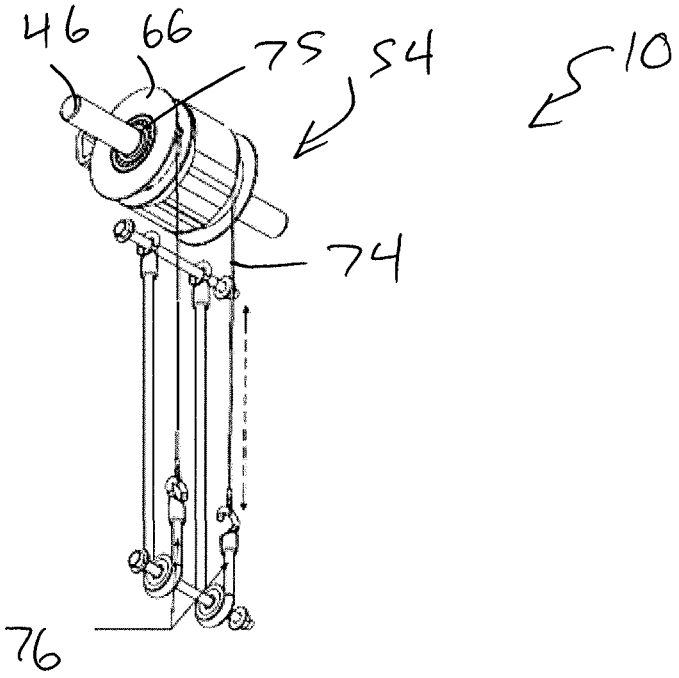
Figure 19:
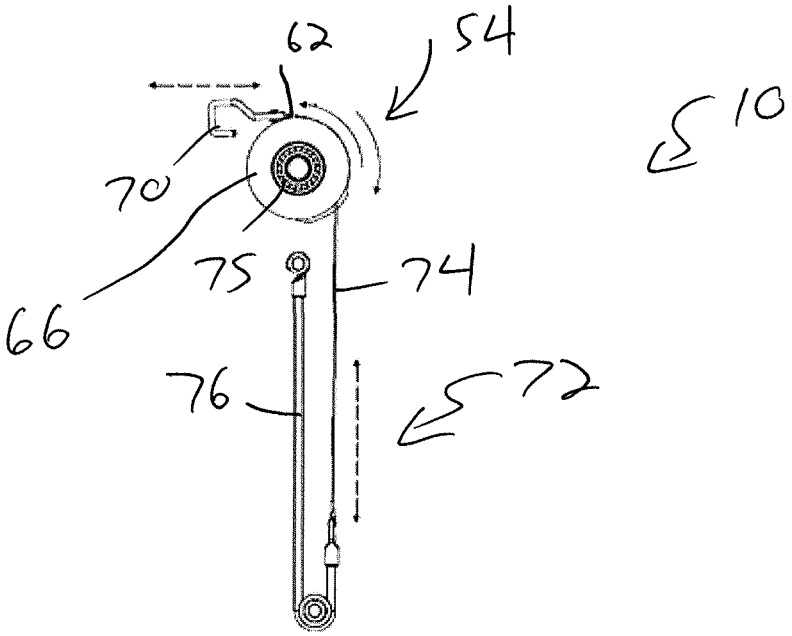

One embodiment of a braking system 18 of the present disclosure is shown in FIGS. 5-13. As shown in FIGS. 5-6, the base 12 may include a substantially flat, rectangular, base plate 34 that can be mounted to a floor using a plurality of bolts (or mounting fasteners) 36. A pair of substantially flat, lifting arm support plates 38 can be connected to and extend upwardly from the base plate 34, and a plurality of plate spacers 40 can be connected between the support plates 38. The apparatus 10 may include a lifting arm pivot shaft 42, a brake drum shaft 44, and a clutch shaft 46 rotatably mounted to the base 12, all of which can be rotatably connected to the support plates 38 using hanger bearings 48. The lifting arm can be connected to and pivot about the lifting arm pivot shaft 42. The base 12 may include a lifting arm adjustable stop 50 and a lifting arm bump pad 52. The base 12, as well as the other parts of the apparatus 10, may be manufactured out of metal such a steel or any other material suitable for handling the weight loads to be placed on the apparatus 10.

In some embodiments, as shown in FIGS. 7-13, the braking system 18 may include a clutch assembly 54 disposed on the clutch shaft 46. A tension strap 62 can be coupled to the lifting arm 14 and wound around the clutch assembly 54. The tension strap 64 in some embodiments can be rotatably connected to the flange 30 of the lifting arm 14 via connection block 64. The connection block 64 can have an opening or recess suitable for receiving a hook 70 located on a distal end of the tension strap 62. The opposing end of the tension strap 62 can be wound around the clutch assembly 54 to couple the clutch assembly 54 to the lifting arm 14.

In some embodiments, as shown in FIGS. 7-8 and 16-19, the braking system can include a biasing member 72 coupled between the base 12 and the clutch assembly 12. The biasing member 72 can bias the clutch assembly to rotate on the clutch shaft 46 such that the tension strap 62 is wound around the clutch assembly 54. In some embodiments, the biasing member 72 can be a bungee/cord assembly. In one embodiment, the bungee/cord assembly 72 may include a pair of cables 74 having one set of ends connected to the clutch assembly 54 and an opposite set of ends connected to a pair of resilient bungee cords 76. The resilient bungee cords 76, in turn, may be partially wrapped around a pair of idler pulleys 78 connected to a plate spacer 40 and then routed upward and hooked over another plate spacer 40. When the lifting arm is in the lowered position, the tension strap 62 can be generally unwound from the clutch assembly, and the cables of the bungee/cable assembly 72 can be partially wound around the clutch assembly 54 to produce spring tension in the bungee cords 76. As the lifting arm 14 is lifted to the raised position, which would otherwise produce slack in the tension cable 62, the bungee cords 76 cause a spring force to be applied to the clutch assembly 54 to rotate such that that the clutch assembly 54 rotates on the clutch shaft 46 to wind the tension strap 62 around the clutch assembly 54 to maintain the tension in the tension strap 62. As the lifting arm 14 is released, the larger weight force of the lifting arm 14 and weights 27 positioned thereon can cause the tension strap to unwind from the clutch assembly 54 such that the cables 74 once again wind around the clutch assembly to tension the bungee cords 76.

In some embodiments, clutch assembly 54 can include a clutch drum 66 disposed around the clutch shaft 46. The clutch drum 66 can include a tension strap spool portion 66*a* and a biasing member spool portion 66*b*. The tension strap 62 can be wound and unwound from tensions trap spool portion 66*a* and the biasing member, and particularly a cable 74 of the bungee/cord assembly 72 can be wound and unwound from the biasing member spool portion 66*b* of the clutch drum 66.

The clutch assembly 54 can be configured to disengage from the clutch shaft 46 and rotate freely on the clutch shaft 46 as the lifting arm 14 is lifted to the raised position. The clutch assembly 54 can be configured to engage and grip the clutch shaft 46 to rotate the clutch shaft 46 as the lifting arm 14 is released and returns to the lowered position. In some embodiments, the roller bearings 75 can be mounted within the clutch drum 66. The one way roller bearings 75 can be configured to rotate freely as the lifting arm 14 is raised and the tension strap 62 is round around the clutch assembly 54 buy the biasing member 72. However, when the lifting arm 14 and the gripping end piece 16 are released by the user to pull on the tension strap 62 to rotate the clutch assembly 54 in the opposite direction, the one way roller bearings 75 can engage the clutch shaft 46 to rotate the clutch shaft 46.

Referring again to FIGS. 7-13, in some embodiments, the braking system 18 can include a brake drum 90 rotatably mounted on the base 12. The brake drum 90 can be coupled to the clutch shaft 46. The brake drum 90 can resist the rotation of the clutch shaft 46 such that when the clutch assembly 54 engages the clutch shaft 46 and rotates the clutch shaft 46 as the lifting arm 14 moves to the lowered position, the brake drum can slow the rotation of the clutch shaft 46 and thus the lowering of the lifting arm 14 via the tension strap 62 to lower the lifting arm 14 at a controlled rate of speed.

In some embodiments, the brake drum 90 can be mounted on the brake drum shaft 44. Clutch shaft sprockets 56 can be connected to opposite ends of the clutch shaft 46, and brake drum shaft sprockets 58 can be connected to opposite ends of the brake drum shaft 44. Roller chains 60 can be disposed around corresponding pairs of clutch shaft sprockets 56 and brake drum shaft sprockets 58 to couple the clutch shaft 46 to the drum brake shaft 44, effectively coupling the brake drum 90 to the clutch shaft 46 and the clutch assembly 54. The roller chains 60 synchronize the rotation of the clutch shaft and brake drum shaft sprockets, 56 and 58, so they rotate at the same time when the clutch assembly 54 engages the clutch shaft 46. When the lifting arm 14 is lifted and the clutch assembly 54 freely rotates on the clutch shaft 46 as previously described, the brake drum 90 is not engaged as the roller chains 60 are not turned by the clutch shaft 46, and thus the brake drum does not affect the rotation of the clutch assembly 54 during the lifting motion.

Figure 23:
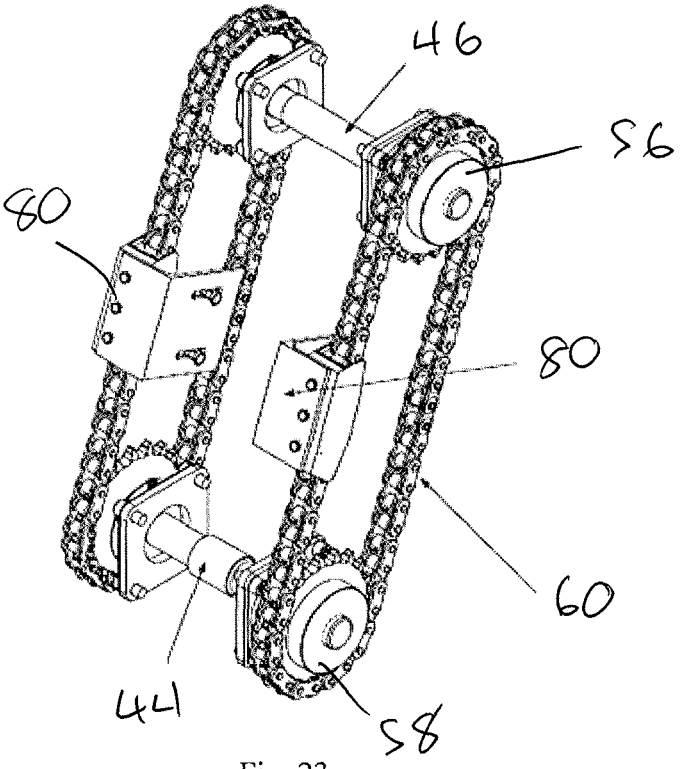
FIGS. 23-24 are detailed views of a sprocket and chain assembly of the braking system of FIG. 1 used to couple a clutch shaft of the braking system to a brake drum shaft of the braking system.
Figure 24:
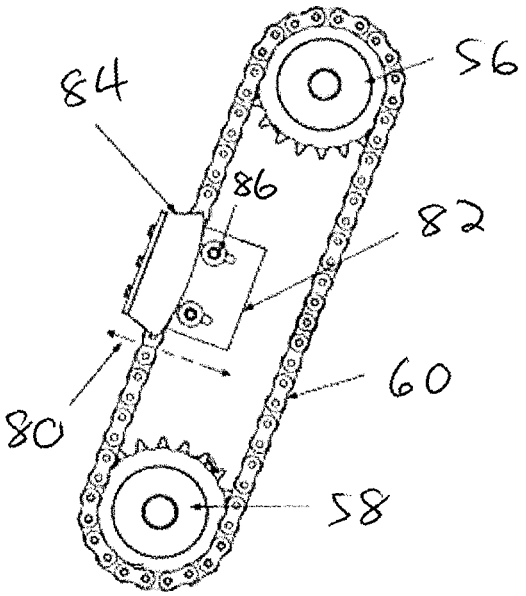
Figure 25:
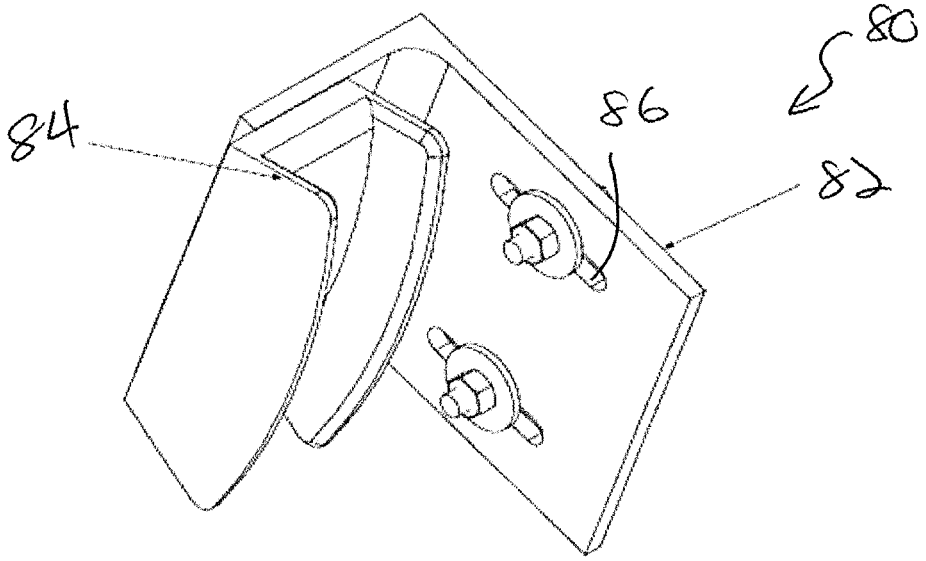
FIG. 25 is a perspective view of an embodiment of a roller chain tensioning assembly of the sprocket and chain assembly of FIGS. 23-24.
Figure 26:
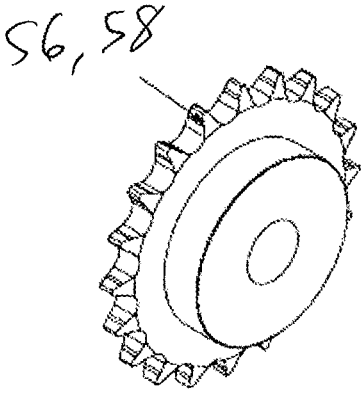
FIG. 26 is a detailed perspective view of a roller chain sprocket of FIGS. 23-24.

Referring now to FIGS. 23-25, the braking system 18 may include a pair of chain tensioner assemblies 80 connected to the support plates 38 for adjusting the tension in the roller chains 60. Each chain tensioner assembly 80 may include a chain tensioner bracket 82 and a chain tensioner slider 84. The bracket 82 may include slots 86 and may be connected to the support plates 38 using bolts and washers. The bracket 82 may be adjusted by loosening the bolts and then moving the bracket 82 along the length of the slots 86 until the roller chains 60 have a desired tension. The bolts and washers may then be used to secure the bracket 82 in place to maintain that tension.

Figure 20:
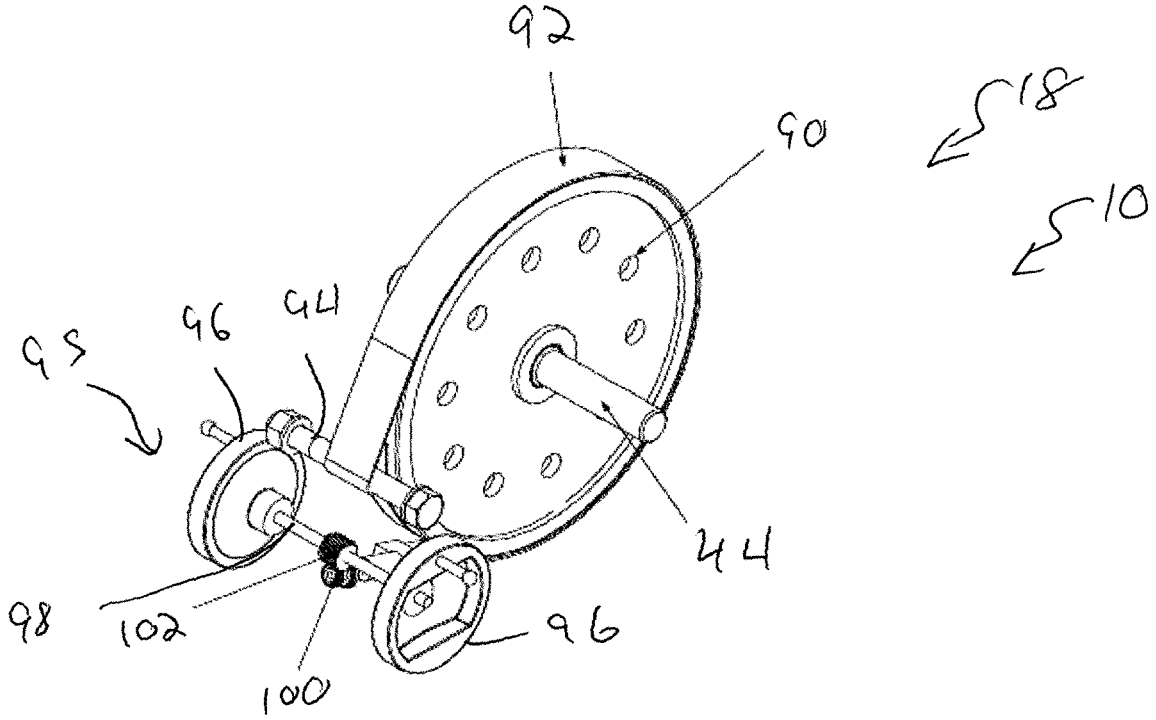
FIGS. 20-22 are perspective views showing one embodiment of a brake drum for the braking system of the apparatus of FIG. 1.
Figure 21:
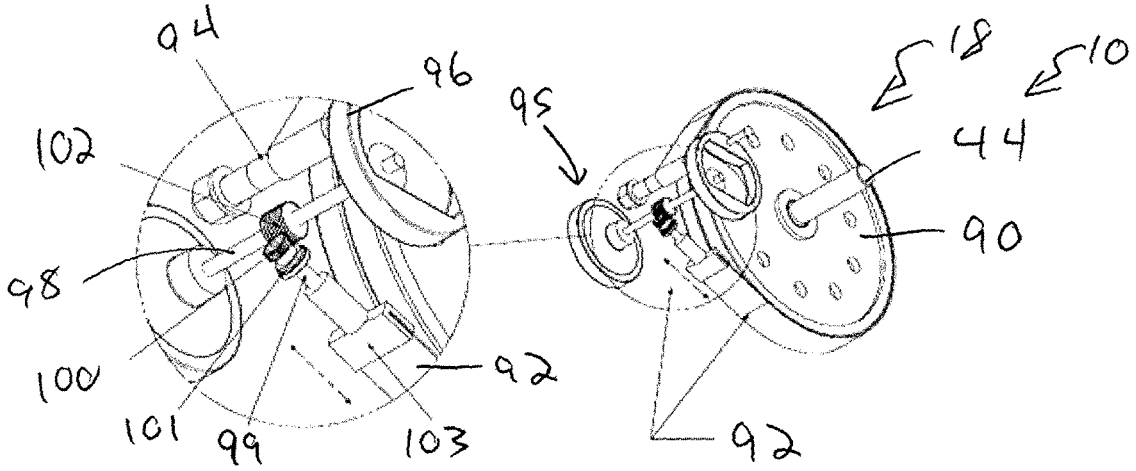
Figure 22:
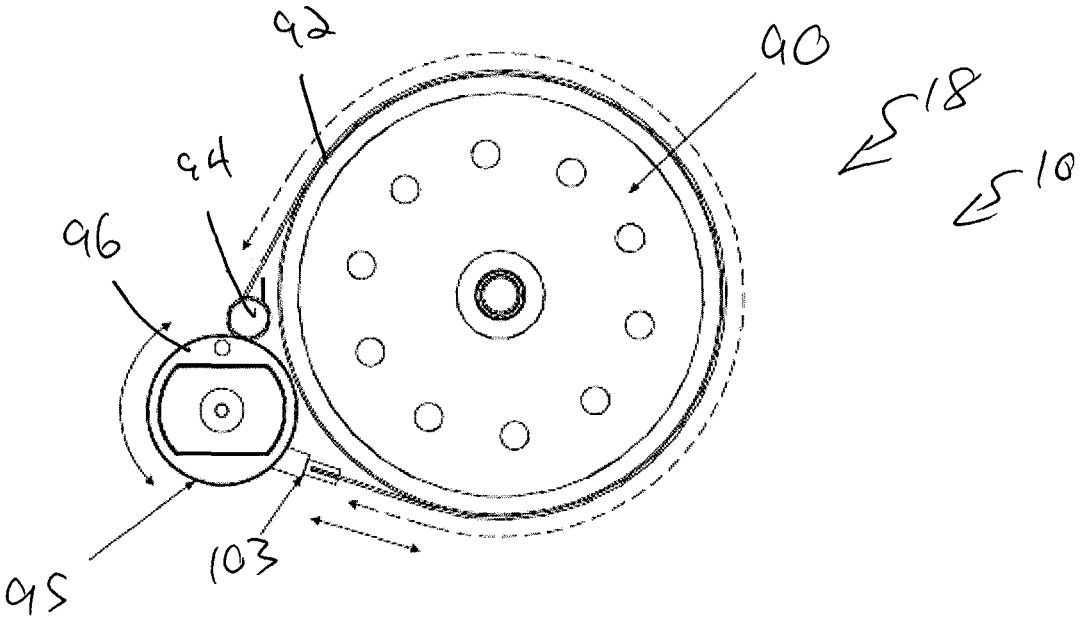

Referring now to FIGS. 20-22, the braking system 18 in some embodiments may include a brake drum friction belt 92 disposed around the brake drum 90. The brake drum friction belt 92 can be tensioned about the brake drum 90 such that as the brake drum 90 rotates, the brake drum friction belt 92 can apply a friction force to the brake drum 90. Resistance to the rotation of the brake drum 90 can in turn resist motion of the clutch assembly on the clutch shaft when the clutch assembly is engaged to rotate the clutch shaft and the brake drum shaft 44, such that the lifting arm can be lowered at a controlled rate of speed. One end of the brake drum friction belt 92 can be secured to a belt anchor bolt 94 mounted to the base and one of the support plates, and the brake drum friction belt 92 can extend around a portion of the outer periphery or a peripheral edge of the brake drum 90.

In some embodiments, the braking system 18 can include a brake drum friction belt adjuster assembly 95 which can be operable to tighten or loosen the tension in the brake drum friction belt 92 to increase or decrease the friction produced on the brake drum 90 during rotation to either speed up or slow down the rate of descent of the lifting arm when the clutch assembly and the brake drum 90 are engaged during the descent of the lifting arm. In some embodiments, the brake drum friction belt adjuster assembly 95 can include an adjuster drive shaft 98 rotatably mounted to the base, the adjuster drive shaft 98 having a first worm gear portion 102, and the brake drum friction belt 92 can be equipped with a second worm gear portion 100 which can be positioned to mesh with the first work gear portion 102 on the adjuster drive shaft 98. A pair of hand wheels 96 can be disposed on either end of the adjuster drive shaft 98. The second worm gear portion 100 can be positioned on a worm gear bearing 101 which can receive a threaded rod 99 which can be coupled to a belt clamp 103 on the end of the brake drum friction belt 92. As a user rotates one of the hand wheels 96, the first worm gear portion 100 on the adjuster drive shaft 98 rotates the second worm gear portion 102 move the threaded rod 99 within the worm gear support bearing 101 to move the end of the brake drum friction belt 92 either toward or away from the second worm gear portion 100 depending on the direction of rotation of the adjuster drive shaft 98 to loosen or tighten the brake drum friction belt 92. This can either reduce or increase the braking forces applied to the brake drum 90 and to either increase or decrease the rate of descent of the lifting arm 14 when the brake drum 90 is engaged. As such, the braking force, and thus the rate of the descent of the lifting arm, can be adjustable and controlled by a user.

Figure 27:
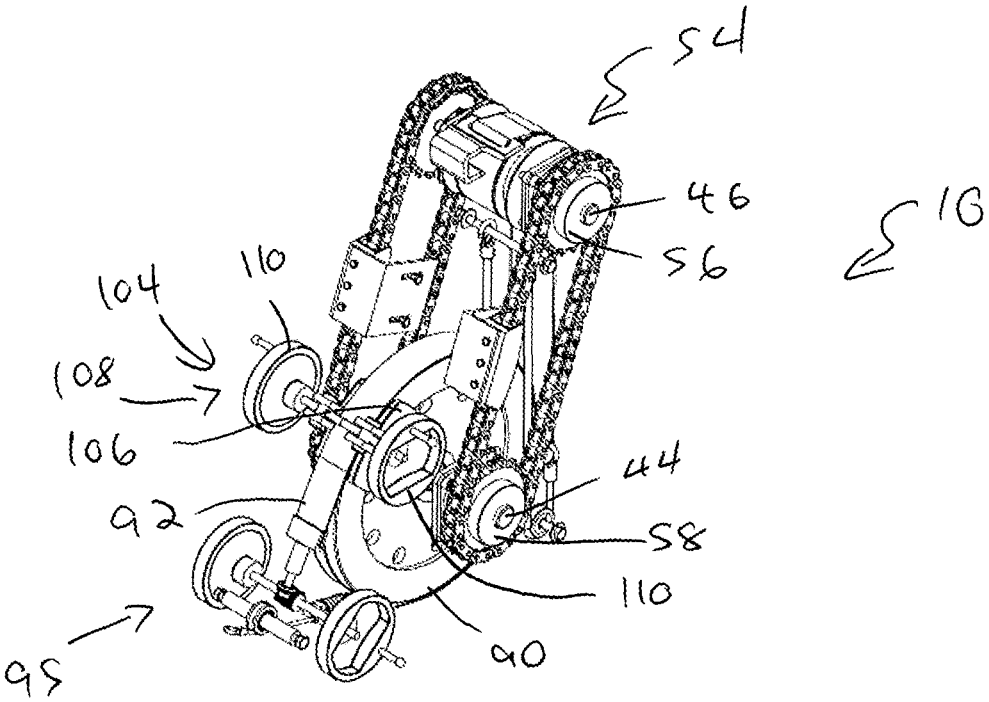
FIGS. 27-30 are perspective views of another embodiment of a braking system for the apparatus of FIG. 1 including a brake pad assembly.
Figure 28:
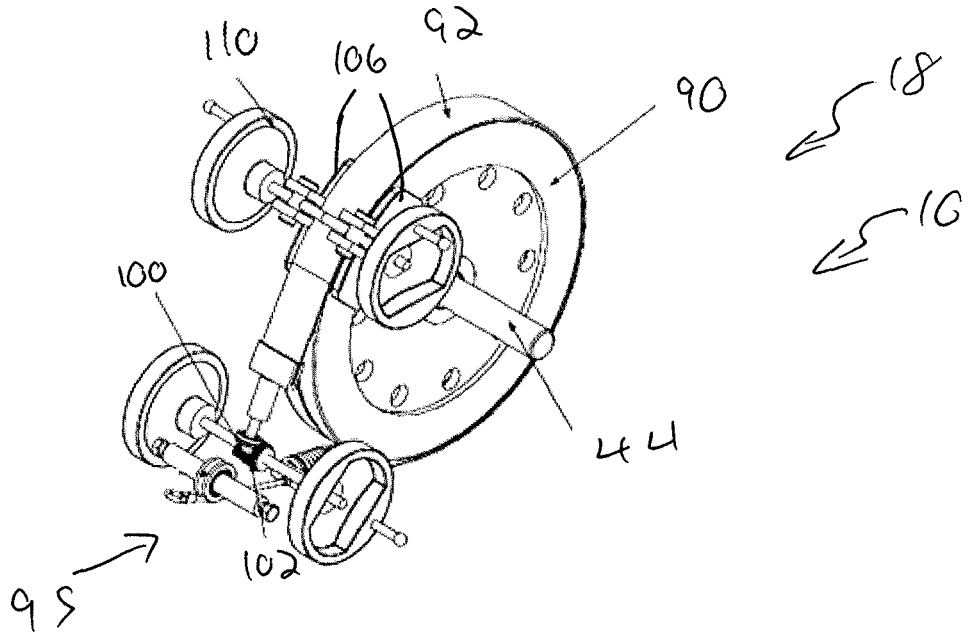
Figure 29:
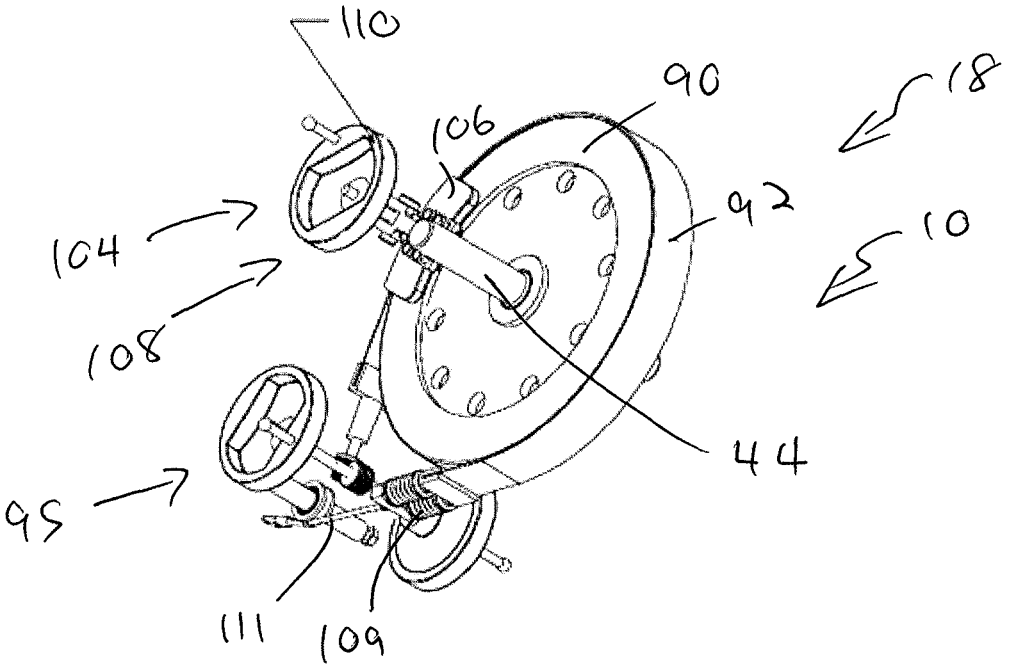

In some embodiments, the braking system 18 may include a brake pad assembly 104, shown in FIGS. 27-30, to further control the descent of the lifting arm 14. The assembly 104 may include a pair of brake pads 106 connected to the support positioned on either side of the brake drum 90. The brake pads 106 can be forced against a sidewall of the brake drum 90 to apply a friction force on the brake drum 90 as the brake drum 90 rotates. A brake pad adjuster assembly 108 can be connected to the pads 106. The brake pad adjuster assembly 108 can be operable to increase or decrease pressure of the brake pads 106 against the brake drum 90. The brake pad adjuster assembly 108 can include a pair of brake pad hand wheels 110 coupled to the brake pads 106. When the brake pad hand wheels 110 are rotated in one direction, the brake pad adjuster assembly 108 can increase the pressure applied by the pads 106 against the brake drum 90 to increase the resistance to the rotation of the brake drum 90 when the clutch assembly is engaged. This, in turn, reduces the speed at which the lifting arm 14 lowers after a lift has been completed. When the hand wheels 110 are rotated in an opposite direction, the adjustment mechanism 108 moves the pads 106 away from the drum 90 to decrease the resistance to the rotation of the brake drum 90 when the clutch assembly 54 is engaged. The decrease in resistance to the rotation of the brake drum 90 can increase the speed at which the lifting arm 14 is lowered after a lift has been completed and the clutch assembly 54 is engaged. While the embodiment of FIGS. 27-29 show both a brake drum friction belt 92 and a brake pad assembly 104 being used to control the rate of speed of the descent of the lifting arm 14, in other embodiments, only a brake drum friction belt 92 can be utilized, and in other embodiments, only a brake pad assembly 104 can be utilized.

Figure 30:
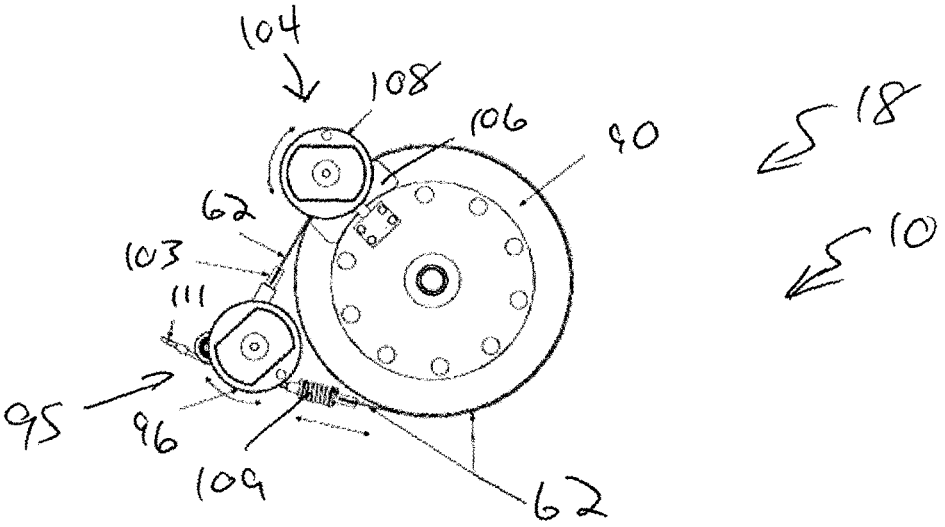
Figure 31:
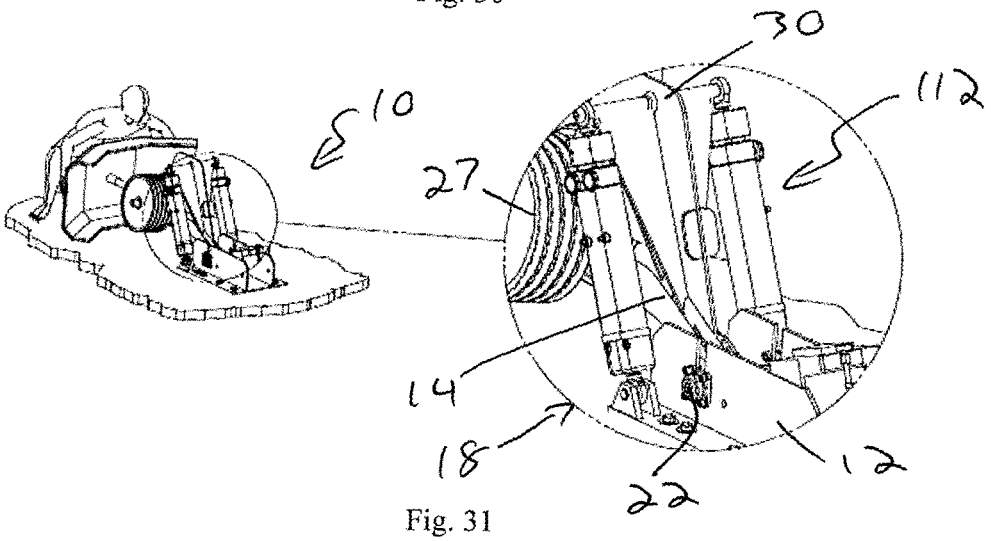
FIGS. 31-33 are perspective views of another embodiment of the present disclosure wherein the braking system includes one or more hydraulic cylinders.
Figure 32:
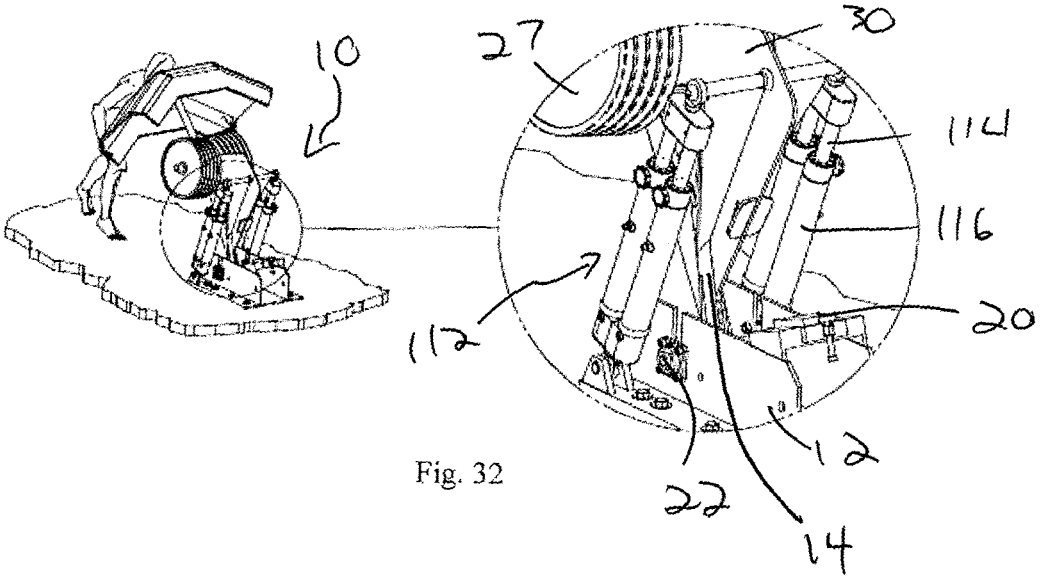
Figure 33:
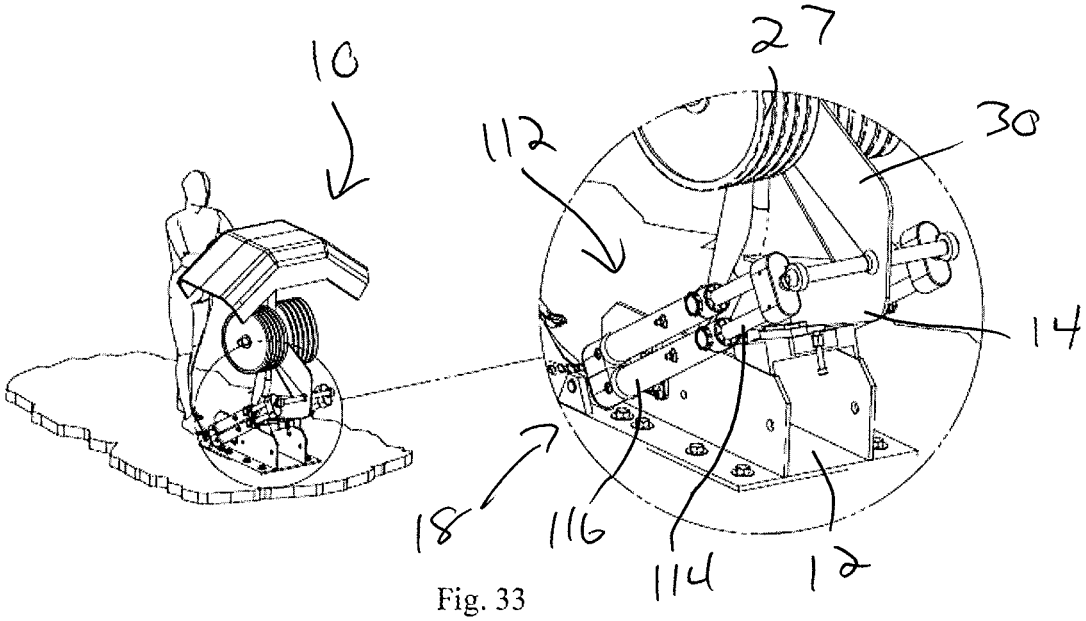
Figure 34:
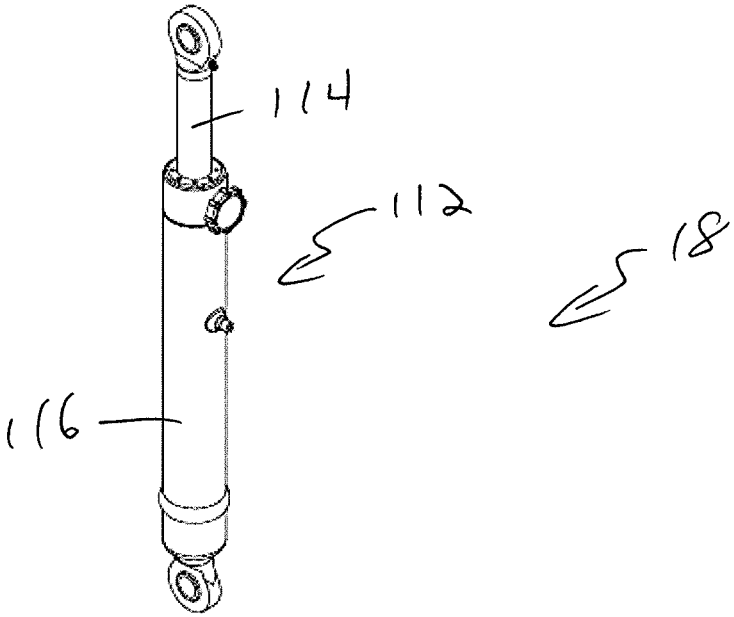
FIG. 34 is a perspective view showing one of the hydraulic cylinders of the apparatus of FIGS. 31-33.
Figure 35:
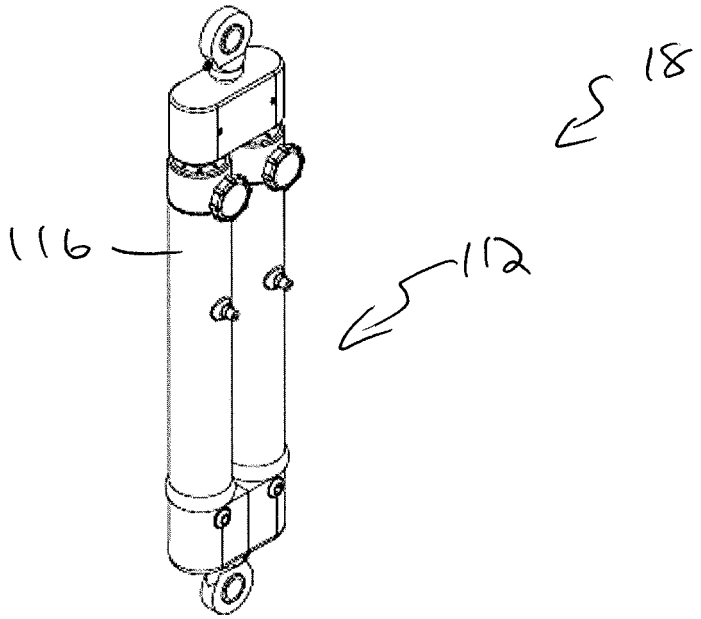
FIG. 35 is a perspective view showing a double cylinder arrangement for the hydraulic cylinders used in the apparatus of FIGS. 31-33.

As shown in FIGS. 29 and 30, in some embodiments, the brake drum friction belt 92 can be coupled directly to the lifting arm, with a spring assembly 109 coupled between the brake drum friction belt 92 and the lifting arm. A cable 11 can be used to connect the spring assembly 109 to the lifting arm. As such, as the lifting arm rotates away from the spring assembly 109 during the descent of the lifting arm, the lifting arm can increase the tension in the spring which can apply a progressive and increasing amount of force on an end of the brake drum friction belt 92 to steadily increase the tension in the belt 92 and increase the resistance against the rotation of the brake drum 90. As the resistance against the rotation of the brake drum 90 increases, the rate of descent of the lifting arm can decrease, such that the rate of descent of the lifting arm can decrease as the lifting arm moves to the lowered position. Such a decrease in the speed of descent can help reduce any damage cause by the lifting arm and the weights thereon contacting the floor or a user inadvertently upon descent.

As shown in FIGS. 31-36, in other embodiments, the braking system 18 can include one or more pneumatic or hydraulic cylinder assemblies 112 to control the descent of the lifting arm 14. In such embodiments, the pistons 114 of the cylinder assemblies 112 can be pivotally connected to the lifting arm 14, and the chambers 116 of the cylinder assemblies 112 can be pivotally connected to the base 12 at a location adjacent the pivot point 22 of the lifting arm 14, such that as the lifting arm is moved to the raised position the pistons 114 extend out of the chambers 116. When the lifting arm 14 is released and moves back toward the lowered position, the weight of the lifting arm 14 and the weights 27 positioned thereon force the piston 114 into the chambers 116 of the cylinder assemblies 112. In some embodiments, a pneumatic or hydraulic cylinder assembly 112 can be positioned on either side of the lifting arm 14 to balance the braking forces applied to the lifting arm 14. In some embodiments, pairs of cylinder assemblies 112 can be positioned on either side of the lifting arm 14.

The cylinder assemblies 112 can be one way cylinder assemblies 112 and can be equipped with internal or external valve assemblies which can be configured to allow the pistons 114 to extend out of the chambers 116 of the cylinder assemblies with little to no resistance, such that no resistance is added by the braking system 18 during the lifting motion of the lifting arm 14. As the lifting arm 14 returns to the lowered position, the valve assemblies can be configured to bleed or expel either hydraulic or pneumatic fluids or gases within the cylinders assemblies 112 at a controlled rate such that the pistons 114 move into the chambers 116 at a controlled rate, which can also control the rate of descent of the lifting arm 14 to the lowered position. For hydraulic cylinders, the chambers 116 can include one or more internal compartments with valve assemblies fluidly communicating the one or more compartments. During descent of the lifting arm 14, hydraulic fluid can be bled from one compartment to the other at a controlled rate by the valve assembly as a piston 114 is compressed into a chamber 116 of a cylinder assembly. The cylinder assemblies 112 can also include internal spring and plunger assemblies which can return the hydraulic fluid to the original compartment through the valve assembly as the lifting arm is lifted and the piston 114 extends out of the chambers 16. One or more air vents can be positioned at an upper end of the chambers 116 such that as the pistons 114 extends out of the chamber 116, air can be exhausted from the chambers to help remove any resistance to the extension motion of the position during the lifting motion of the lifting arm 14.

Figure 36:
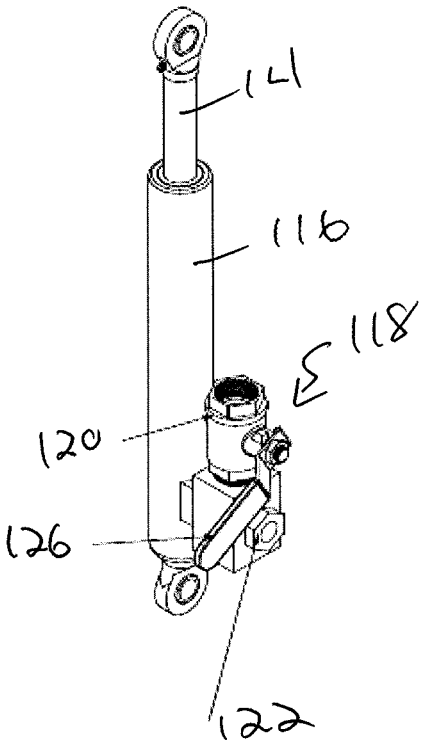
FIG. 36 is a perspective view of an embodiment of a pneumatic cylinder that can be used in place of the hydraulic cylinders of FIGS. 31-33.
Figure 36A:
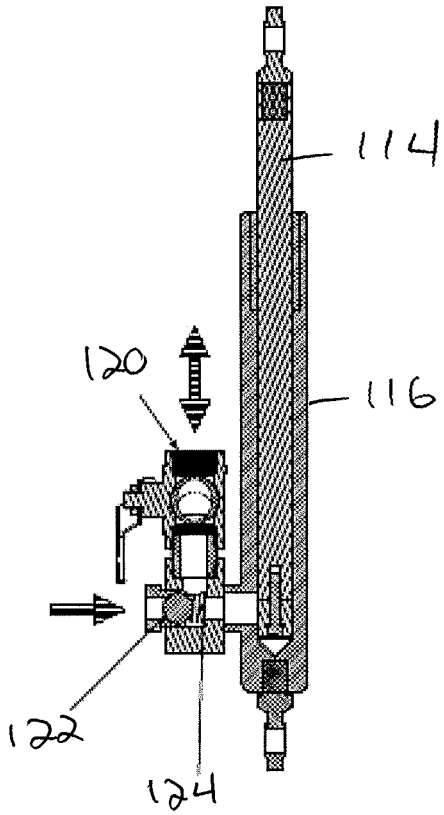
FIG. 36*a* shows a cross sectional view of the pneumatic cylinder of FIG. 36.

One embodiment of a valve assembly 118 for a pneumatic cylinder assembly 112 is shown in FIGS. 36 and 36*a*. The valve assembly 118 can include a main valve 120, as well as a one way check valve 122 communicated with an internal compartment of the chamber 116. The main valve 120 can allow a controlled amount of air to pass in either direction through the main valve 120. The one way check valve 122 can include a check valve spring 124 which can bias a ball of the check valve 124 to close the check valve. The check valve 122 is only opened when a suitable force is applied to the ball of the check valve 122 to compress the check valve spring 124. As such, during descent of the lifting arm, when the piston 114 would force air from the internal compartment of the chamber 116 and out of the valve assembly, the forced air would be applied on the ball of the check valve 122 in a direction away from the check valve spring 124, such that the check valve 122 would remain closed, and air from the internal compartment of the chamber would be bled or expelled through the main valve 120 at a controlled rate to control the rate of descent of the lifting arm. In some embodiments, the main valve 120 can include an adjustment handle 126 which can further open or close the main valve 120 to adjust the amount of air allowed to pass through the main valve 120, such that rate of descent of the lifting arm can be adjustable.

As the lifting arm is moved to the raised position and the piston 114 is extended out of the chamber 116, air can enter through the main valve 120 to fill the space created in the chamber 116 by the extended piston 114. If air cannot enter through main valve 120 quickly enough, such that a back pressure builds up within the internal chamber, the back pressure can compress the ball of the check valve 122 against the spring to open the check valve and equalize the pressure within the internal compartment of chamber 116 with the ambient air such that the cylinder assembly 112 can apply little to no resistance to the lifting arm 14 during the lifting motion.

Figure 37:
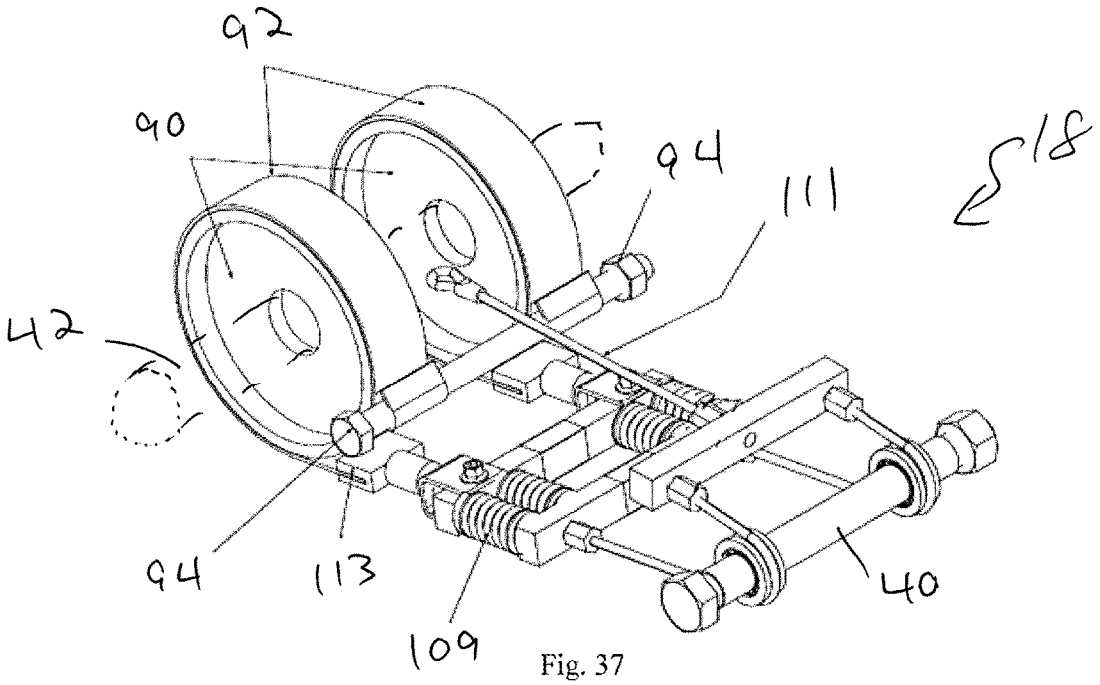
FIGS. 37-39 are a perspective view of another embodiment of a friction brake drum braking system that can be used with a workout apparatus of the present disclosure.
Figure 38:
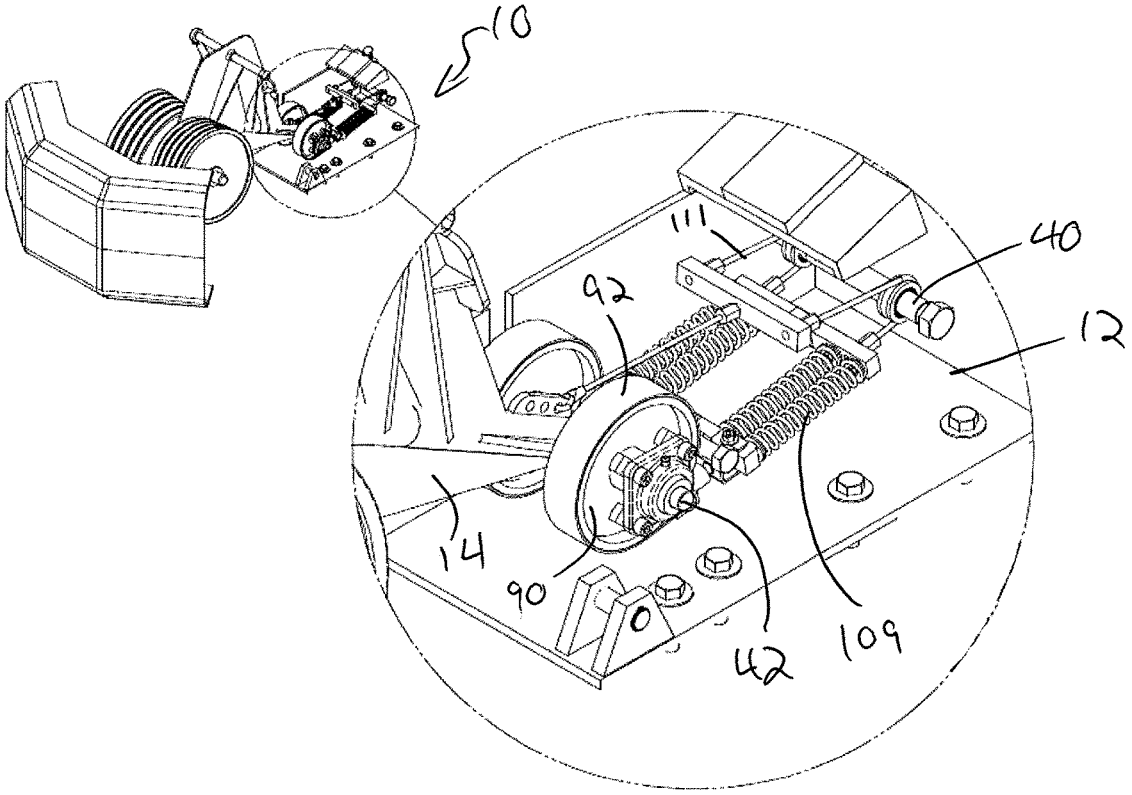
Figure 39:
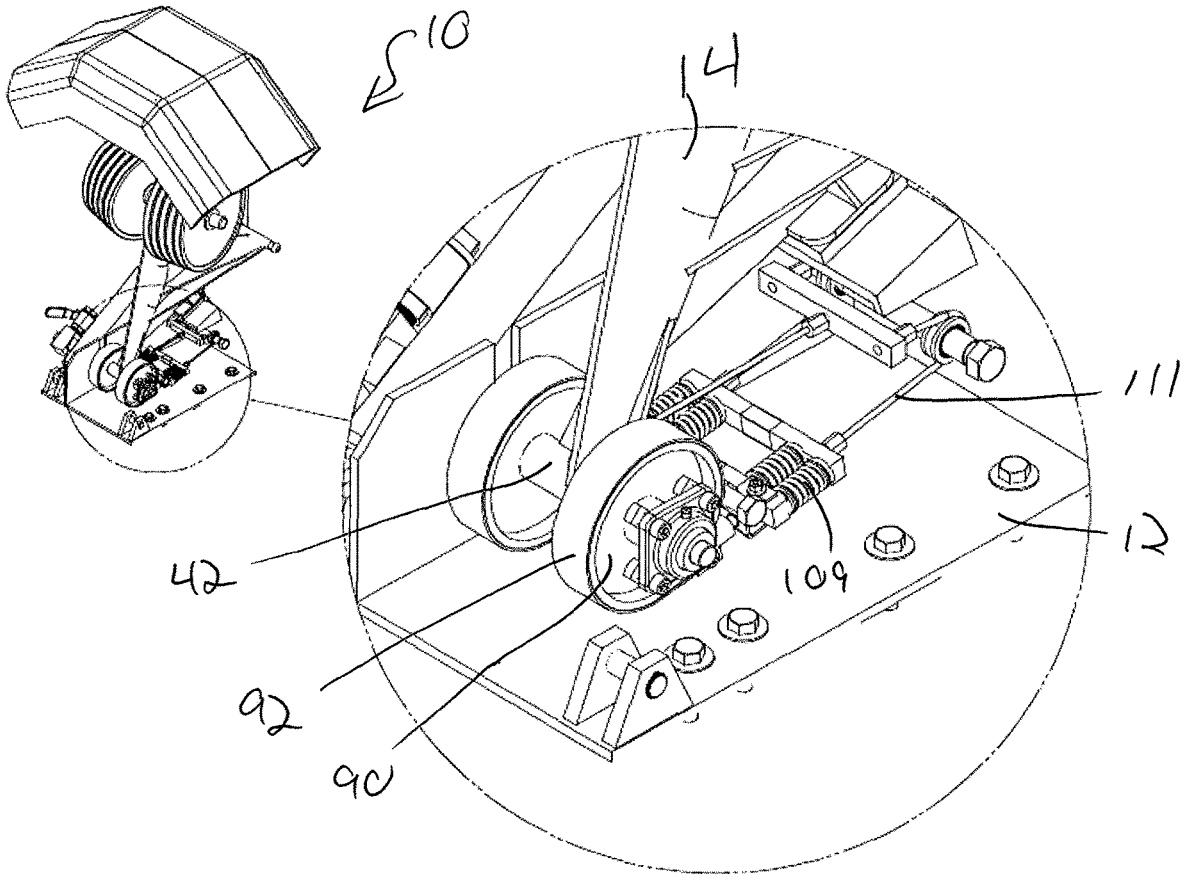

In embodiments with cylinder assemblies 112, the braking system 18 can optionally include a secondary braking mechanism. In some embodiments, the secondary breaking mechanism can include a brake drum 90 and brake drum friction belt 92. In some embodiments, as shown in FIGS. 37-39, the brake drum 90 and brake drum friction belt 92 can be similar to those described in the embodiments of FIGS. 20-21, except that the brake drum 90 can be disposed directly on the lifting arm pivot shaft 42 such the brake drum 90 is rotated directly by the lifting arm, and resistance to rotation of the brake drum 90 by the brake drum friction belt 92 directly affects the rotation of the lifting arm about the lifting arm pivot shaft 42. In some embodiments, a spring assembly 109 can be coupled between the brake drum friction belt 92 and the lifting arm via lifting arm cable 111.

Lifting arm cable 111 can extend around a cross support 40 of the base and attach to the lifting arm, such that as the lifting arm moves to the lowered position and away from the base, the lifting arm will pull the lifting arm cable such that tension is increased in the spring assembly 11 which will increase the tension in the brake drum friction belt 92. As such, as the lifting arm moves to the lowered position, resistance to rotation of the brake drum 90, and thus the lifting arm, will progressively increase to slow the rate of the descent of the lifting arm as the lifting arm moves to the lowered position. In some embodiments, the braking system 18 may include two pairs of brake drums 90 and brake drum friction belts 92 disposed on the lifting arm pivot shaft 42.

Figure 40:
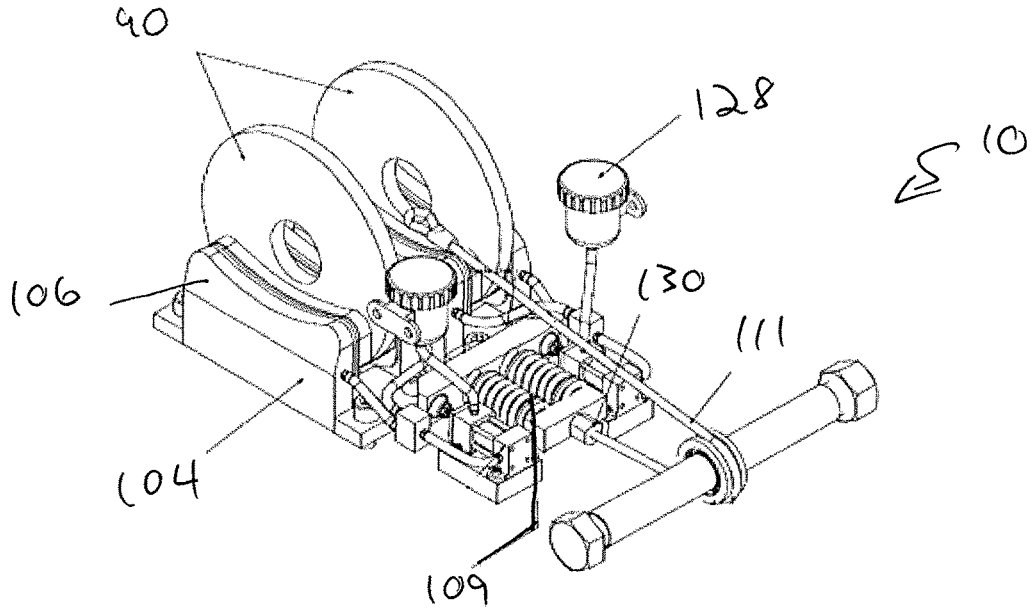
FIG. 40 is a perspective view of an embodiment of a braking system having a hydraulic brake pad or caliper system which can be used with a workout apparatus of the present disclosure.
Figure 41:
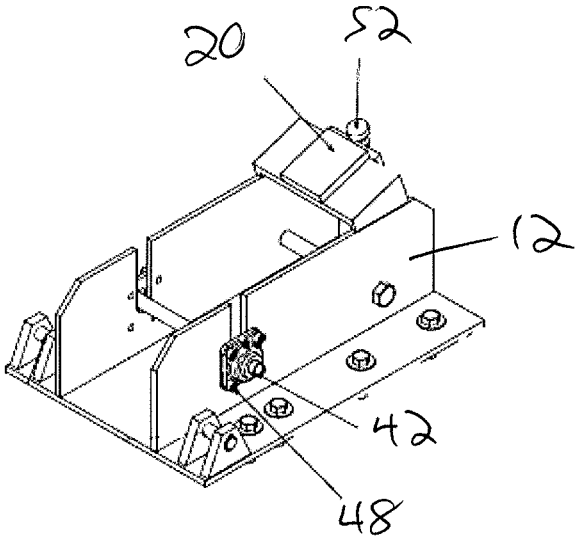
FIG. 41 is a perspective view of the base used with the workout apparatuses of FIGS. 31-33.

In some embodiments, the apparatus 10 may further include a brake pad assembly 104 similar to the brake pad assembly 104 discussed previously. In some embodiments, as shown in FIG. 40, the brake pad assembly 104 can apply pressure on the brake drum 90 via the brake pads 106 using a hydraulic system. A fluid reservoir 128 can provide pressurized hydraulic fluid to the brake pads 106 via a pressure cylinder and a network of fluid lines. A controlled pressure can be applied to the pressure cylinder such that a controlled pressure can be applied to the brake drum 90 via the brake pads 106 through the fluid lines of the hydraulic system. In some embodiments, a spring assembly 109 can be connected between the pressure cylinder of the hydraulic system and the lifting arm via lifting arm cable 111 such that as lifting arm moves to the lowered position, lifting arm cable 111 can tension the spring assembly 109 to increase the pressure applied to the pressure cylinder of the hydraulic brake pad system 104. As such, as the lifting arm moves to the lowered position, the pressure applied by the brake pads 106 on the brake drum 90 can increase to progressively decrease the rate of descent of the lifting arm.

While various embodiments of a braking system 18 for the workout apparatus 10 of the present invention have been discussed herein, it is contemplated that the various braking methods discussed herein can be used either alone or in combination with one another to add multiple breaking features to the apparatus to control the rate of descent of the lifting arm to the lowered position.

The various workout apparatuses 10 discussed herein add a great benefit compared to traditional tire flipping type work outs. Firstly, the amount of space necessary for a tire-flipping workout is dramatically decreased as the apparatus 10 remains in a stationary location, as opposed to tires being continuously flipped over and over across an open space. Additionally, the controlled descent of the lifting arm and the gripping end piece provided by the braking systems 18 disclosed herein can help reduce injury to the user, an observer, or nearby property as the path of descent of the lifting arm, as well as the speed of the descent, is controlled by the apparatus. As such a user can bail out of a lift, or release the gripping end piece after a completed lifting motion, with the confidence that the gripping end piece will not fall back on them or someone else.

Thus, although there have been described particular embodiments of the present invention of a new and useful WORKOUT APPARATUS, it is not intended that such references be construed as limitations upon the scope of this invention.

What is claimed is:

1. A workout apparatus, comprising:

a base;

a lifting arm pivotally connected to the base at a pivot point on the base and movable on the base between a raised position and a lowered position, the lifting arm including a first end pivotally connected to the base and a second end opposite the first end, the second end including a gripping end piece having the shape of a partial tire, wherein as the lifting arm moves from the lowered position to the raised position, a center of gravity of the lifting arm and the gripping end piece moves past the pivot point on the base in a horizontal direction;

at least one weight post extending outward from the lifting arm at a location between the first end and the second end of the lifting arm; and a braking system mounted to the base and coupled to the lifting arm, the braking system allowing the lifting arm to move toward the raised position freely, wherein the braking system is engaged as the lifting arm moves towards the lowered position to lower the lifting arm toward the lowered position at a controlled rate of speed.

2. The apparatus of claim 1, wherein the braking system further comprises:

a clutch shaft rotatably mounted to the base;

a clutch assembly disposed on the clutch shaft; and a tension strap coupled to the lifting arm and wound around the clutch assembly;

wherein the clutch assembly disengages from the clutch shaft as the lifting arm is raised to the raised position, the clutch assembly engaging the clutch shaft when the lifting arm is released and moves to the lowered position.

3. The apparatus of claim 2, wherein the braking system further comprises a brake drum rotatably of the clutch shaft when the clutch assembly engages and turns the clutch shaft to lower the mounted to the base and coupled to the clutch shaft, the brake drum resisting rotation lifting arm at a controlled rate of speed.

4. The apparatus of claim 3, further comprising:

a brake drum friction belt disposed around the brake drum, the brake drum friction belt producing friction on the brake drum as the brake drum rotates to resist rotation of the brake drum; and a brake drum friction belt adjuster assembly mounted to the base and operable to tighten or loosen the tension in the brake drum friction belt.

5. The apparatus of claim 3, further comprising:

a brake pad assembly engaged with a sidewall of the brake drum, the brake pad assembly producing friction on the brake drum as the brake drum rotates to resist rotation of the brake drum; and a brake pad adjuster assembly mounted to the base and operable to increase or decrease pressure of the brake pad against the brake drum.

6. The apparatus of claim 3, wherein the brake drum is positioned on a brake drum shaft rotatably mounted on the base, and the braking system further comprises:

a clutch shaft sprocket positioned on the clutch shaft;

a brake drum sprocket positioned on the brake drum shaft; and a sprocket chain coupled around the clutch shaft sprocket and the brake drum shaft sprocket to couple the clutch shaft to the brake drum via the brake drum shaft.

7. The apparatus of claim 2, wherein the braking system further comprises a biasing member coupled between the base and the clutch assembly, the biasing member biasing the clutch assembly to rotate on the clutch shaft such that the tension strap is wound around the clutch assembly.

8. The apparatus of claim 7, wherein the clutch assembly includes a clutch drum disposed around the clutch shaft, the clutch drum having a tension strap spool portion and a biasing member spool portion, the tension strap receivable in the tension strap spool portion and the biasing member receivable in the biasing member spool portion.

9. The apparatus of claim 2, wherein the clutch assembly includes one or more one way roller bearings that freely rotate on the clutch shaft as the lifting arm moves from the lowered position to the raised position, the one or more one way roller bearings engaging the clutch shaft as the lifting arm moves from the raised position to the lowered position.

10. The apparatus of claim 1, further comprising a padded adjustable stop mounted on the base, the padded adjustable stop positioned to prevent motion of the lifting arm beyond the raised position.

11. The apparatus of claim 1, wherein the braking system further comprises a hydraulic cylinder pivotally connected between the base and the lifting arm, the hydraulic cylinder operable to resist movement of the lifting arm from the raised position to the lowered position to lower the lifting arm to the lowered position at a controlled rate of speed.

12. The apparatus of claim 1, wherein the braking system further comprises a pneumatic cylinder pivotally connected between the base and the lifting arm, the pneumatic cylinder operable to resist movement of the lifting arm from the raised position to the lowered position to lower the lifting arm to the lowered position at a controlled rate of speed.

13. The apparatus of claim 1, wherein lifting arm pivots about the base on a lifting arm pivot shaft, and the braking system further comprises:

a brake drum disposed on the lifting arm pivot shaft; and a brake drum friction belt disposed around at least a portion of a peripheral edge of the brake drum;

wherein as the lifting arm rotates on the base, the lifting arm pivot shaft rotates the brake drum, and the brake drum friction belt produces a friction force on the brake drum to resist the rotation of the brake drum and the lifting arm.

14. A workout apparatus, comprising:

a base;

a lifting arm pivotally connected to the base at a pivot point on the base and movable on the base between a raised position and a lowered position, the lifting arm including a first end pivotally connected to the base and a second end opposite the first end, the second end including a tire-shaped gripping end piece, wherein as the lifting arm moves from the lowered position to the raised position, a center of gravity of the lifting arm and the tire-shaped gripping end piece moves past the pivot point on the base in a horizontal direction;

at least one weight post extending outward from the lifting arm at a location between the first end and the second end of the lifting arm; and a braking system mounted to the base and coupled to the lifting arm, the braking system including a brake drum;

wherein the braking system is disengaged from the lifting arm as the lifting arm moves toward the raised position;

wherein the braking system engages the lifting arm as the lifting arm moves from the raised position to the lowered position, and the brake drum resists the movement of the lifting arm to the lowered position such that the lifting arm moves toward the lowered position at a controlled rate of speed; and wherein the base includes an angular stop oriented such that when the lifting arm is lifted to the raised position, the angular stop maintains the lifting arm in a substantially vertical orientation.

* * * * *